US007796109B2

(12) United States Patent
Mamba et al.

(10) Patent No.: US 7,796,109 B2
(45) Date of Patent: Sep. 14, 2010

(54) DISPLAY DEVICE AND, METHOD FOR CONTROLLING A DISPLAY DEVICE

(75) Inventors: Norio Mamba, Kawasaki (JP); Toshio Miyazawa, Chiba (JP); Yasuyuki Kudo, Fujisawa (JP)

(73) Assignee: Hitachi Displays, Ltd., Chiba (JP)

( * ) Notice: Subject to any disclaimer, the term of this patent is extended or adjusted under 35 U.S.C. 154(b) by 1141 days.

(21) Appl. No.: 11/443,448

(22) Filed: May 31, 2006

(65) Prior Publication Data

US 2007/0008270 A1 Jan. 11, 2007

(30) Foreign Application Priority Data

Jun. 3, 2005 (JP) ..... 2005-164447
Feb. 14, 2006 (JP) ..... 2006-036626

(51) Int. Cl.
*G09G 3/36* (2006.01)

(52) U.S. Cl. ..... 345/98; 345/87

(58) Field of Classification Search ..... None
See application file for complete search history.

(56) References Cited

U.S. PATENT DOCUMENTS 6,686,899 B2 2/2004 Miyazawa et al.
6,747,640 B2 * 6/2004 Okuno et al. ..... 345/213

FOREIGN PATENT DOCUMENTS

JP 2002-251174 A 9/2002

* cited by examiner

*Primary Examiner*—Alexander Eisen
*Assistant Examiner*—Robin Mishler
(74) *Attorney, Agent, or Firm*—McDermott Will & Emery LLP

(57) ABSTRACT

A voltage level converter for driving resistive and capacitive loads of a display device includes a charge circuit having a capacitance, a transistor NMOS1, a capacitance, and a transistor; a discharge circuit having transistors; and a reset signal generating circuit provided in a preceding stage of the discharge circuit. A signal having an inverted phase to an input pulse is applied to the reset signal generating circuit. An output of the reset signal generating circuit is supplied to gate terminals of the transistors, thus realizing reliable turning ON or OFF the discharge circuit.

3 Claims, 18 Drawing Sheets

DISPLAY DEVICE AND, METHOD FOR CONTROLLING A DISPLAY DEVICE

INCORPORATION BY REFERENCE

The present application claims priority from Japanese applications JP2005-164447 filed on Jun. 3, 2005 and JP2006-036626 filed on Feb. 14, 2006 the contents of which are hereby incorporated by reference into this application.

BACKGROUND OF THE INVENTION

The present invention relates to display devices and methods for controlling the display devices, and more particularly, to a display device of an active matrix type having a display driving circuit formed on a substrate of a display panel and a method for controlling the display device.

In a liquid crystal display device as one type of the active matrix type display devices, regions surrounded by two of a plurality of gate signal lines provided in a vertical direction and by two of a plurality of drain signal lines provided in a horizontal direction are formed on a surface of one of two substrates having a liquid crystal disposed therebetween which is contacted with the liquid crystal and are used as a single pixel region.

The pixel region has a thin film transistor operated by a scan signal supplied from one of the two gate signal lines and a pixel electrode to which a video signal is supplied from one drain signal line via the thin film transistor.

The pixel electrode generates an electric field, for example, between the pixel electrode and an electrode opposed thereto and formed on the other of the two substrates. The electric field is used to control the light transmissivity of the liquid crystal provided between these electrodes. Such a liquid crystal display device comprises a scan signal driving circuit for supplying the scan signal to the respective gate signal lines and a video signal driving circuit for supplying a video signal to the respective drain signal lines.

Each of these scan signal driving circuit and video signal driving circuit includes a multiplicity of MIS (metal insulator semiconductor) transistors having a structure similar to the thin film transistor formed in the pixel region. Thus, such signal driving circuits are known as having such an arrangement that a semiconductor layer in each of the transistors is made of polycrystalline silicon (p-Si) and these signal driving circuits are formed on one substrate concurrently with pixel formation.

Such a circuit as to have many polycrystalline silicon transistors has a low output voltage. Therefore, when such a low output voltage is used as it is, it may be, in some cases, impossible to obtain a necessary driving voltage.

Further, when it is assumed that a control signal (such as a clock signal) necessary to operate these circuits is supplied from an LSI or the like provided in the periphery of the substrate, and when the breakdown voltage of the LSI is low, there may occur such a situation that the low voltage of the control signal issued from the LSI causes the circuits not to be sufficiently operated. To avoid such a situation, a voltage level converter for converting a voltage such as a pulse from its low level to high is built in such circuits.

Such a voltage level converter circuit is disclosed in U.S. Pat. No. 6,686,899 (JP-A-2002-251174). The voltage level converter circuit has a feature of being capable of sufficiently suppressing a through current. In one of embodiments of the converter circuit, the converter includes MIS transistors of an identical conduction type (N or P). In FIG. 11C of the U.S. Pat. No. 6,686,899 (JP-A-2002-251174), an input terminal for an input pulse VIN is connected to a first terminal of a first MIS TFT NMOS1, an input terminal for an input pulse /VIN having an inverted phase to the input pulse VIN ("/" in /VIN denotes bar, meaning a pulse corresponding to inversion of the input pulse VIN) is connected to a gate terminal of a second MIS TFT NMOS2, a gate terminal of the transistor NMOS1 is connected to a supply side of a power source for supplying a constant voltage VDH, a first terminal of the transistor NMOS2 is connected to a supply side of a power source for supplying a low voltage VAL, a second terminal of the transistor NMOS1 is connected to a first terminal of a capacitance and to a gate terminal of a third MIS TFT NMOS3, a first terminal of the transistor NMOS3 is connected to a supply side of a power source for supplying a high voltage VAH, and a second terminal of the transistor NMOS2 is connected to a second terminal of the capacitance and to a second terminal of the transistor NMOS3, which interconnection forms an output terminal.

SUMMARY OF THE INVENTION

Assume, in FIG. 11C of the voltage level converter circuit of the U.S. Pat. No. 6,686,899 (JP-A-2002-251174), that the input signals VIN and /VIN have a high (Hi) level voltage of VDH and a low (Low) level voltage of VDL. When an low-side output voltage VAL of the voltage level converter has the same level as VDL and an high-side output voltage VAH of the converter is higher than VDH, the converter performs its normal level conversion as shown in the U.S. Pat. No. 6,686,899 (JP-A-2002-251174).

Consider now a case where VDL is different from VAL and VDL>VAL. As has been explained above, the input signal /VIN is applied to the gate terminal of the transistor NMOS2 in the voltage level converter circuit and the output voltage VAL is applied to the first terminal thereof.

When the input signal /VIN is at a low level, a voltage at the first terminal with respect to the gate terminal of the transistor NMOS2 becomes VDL−VAL. At this time, if VDL−VAL is larger than a threshold voltage Vth of the transistor NMOS2, then the transistor NMOS2 is put in its ON state.

For this reason, even when VIN is at a high level and the transistor NMOS3 is in its ON state, the voltage of the output terminal is pulled to the output voltage VAL. Thus, the converter cannot normally convert the voltage to the VAH level.

Conversely, when the threshold voltage Vth of the transistor NMOS2 is made to be larger so that a relation, Vth>(VDL−VAL), is satisfied; the high level of the voltage VIN causes the voltage to be largely reduced by the threshold voltage of the transistor NMOS1, at which time the ON resistance of the transistor NMOS3 becomes high. As a result, there arises a problem that a rise in the output voltage becomes slow.

It is therefore an object of the present invention to provide a display device which comprises a voltage level converter capable of performing level conversion by sufficiently suppressing a through current when the low level of an input signal is different from the low level of an output signal, in particular, even when the low level of the output signal is lower than the low level of the input signal; and also to provide a method for controlling the display device.

In accordance with an aspect of the present invention, there is provided a voltage level converter which comprises a charger circuit for driving a load circuit in response to an input pulse, a discharge circuit for driving the load circuit in response to an inverted input pulse, and a reset signal generating circuit provided at the preceding stage of the discharge circuit. The reset signal generating circuit causes the discharge circuit to be positively turned ON or OFF.

More specifically, a drive circuit including the voltage level converter is provided on an insulating substrate, and the voltage level converter includes MIS TFTs as switching elements having a semiconductor layer made of polycrystalline silicon. An input terminal for an input pulse is connected to a first terminal of a first n type MIS transistor NMIS1 and a gate terminal thereof via a first capacitance and also to a first terminal of a second n type MIS transistor NMIS2. A second terminal of the transistor NMIS1 is connected to a gate terminal of a third n type MIS transistor NMIS3, to a first terminal of a fourth n type MIS transistor NMIS4, and also to one terminal of a second capacitance. A first terminal of the transistor NMIS3 is connected to the other terminal of the second capacitance and also to a first terminal of a fifth n type MIS transistor NMIS5, which interconnection forms an output terminal of the voltage level converter. A second terminal of the transistor NMIS3 is connected to a high voltage source wiring line. Respective second terminals of the transistors NMIS2, NMIS4, and NMIS5 are connected to a low voltage source wiring line. A signal having a phase inverted to the input pulse is connected to an input terminal of a reset signal generating circuit. An output terminal of the reset signal generating circuit is connected to gate terminals of the transistors NMIS2, NMIS4, and NMIS5.

The input terminal of the reset signal generating circuit is connected to the output terminal of the circuit via a third capacitance and also to a first terminal of a sixth n type MIS transistor NMIS6 and a gate terminal thereof. A second terminal of the transistor NMIS6 is connected to a first terminal of a seventh n type MIS transistor NMIS7 and a gate terminal thereof, and a second terminal of the transistor NMIS7 is connected to the low voltage source wiring line.

In accordance with another aspect of the present invention, there is provided a method for controlling a display device having a voltage level converter. A set signal sent from outside of the display device is stored in a set value memory, read out therefrom, and then supplied to a control signal generator. The control signal generator generates an input pulse of the same polarity and an inverted pulse to control the initial state of the voltage level converter on the basis of the set signal.

In the voltage level converter arranged in this manner and included in the display device, even when the low level of the input pulse is different from the potential of the low voltage source and when the high level of the input pulse is different from the potential of the high voltage source, the transistors NMIS2, NMIS4, and NMIS5 can be put in the OFF state when a high level of signal is applied to the input pulse and therefore the converter can suppress a through current and converts the input voltage to a desired level of voltage.

In accordance with the present invention, the voltage level converter provided in the liquid crystal display device can sufficiently suppress its through current and realize a low power consumption.

Further, even when the low level of the input signal is different from the low level of the output signal and the high level of the input signal is different from the high level of the output signal, the voltage level converter can perform its level conversion. Thus, the voltage amplitude of the output signal of an LSI installed in the vicinity of the converter can be lowered and therefore the breakdown voltage and cost of the peripheral LSI can be expected to be lowered.

In accordance with the present invention, further, a circuit controlled by the output signal of the voltage level converter can be stably driven without causing any erroneous operation.

Other objects, features and advantages of the invention will become apparent from the following description of the embodiments of the invention taken in conjunction with the accompanying drawings.

DESCRIPTION OF THE EMBODIMENTS

Embodiment 1

Figure 1:
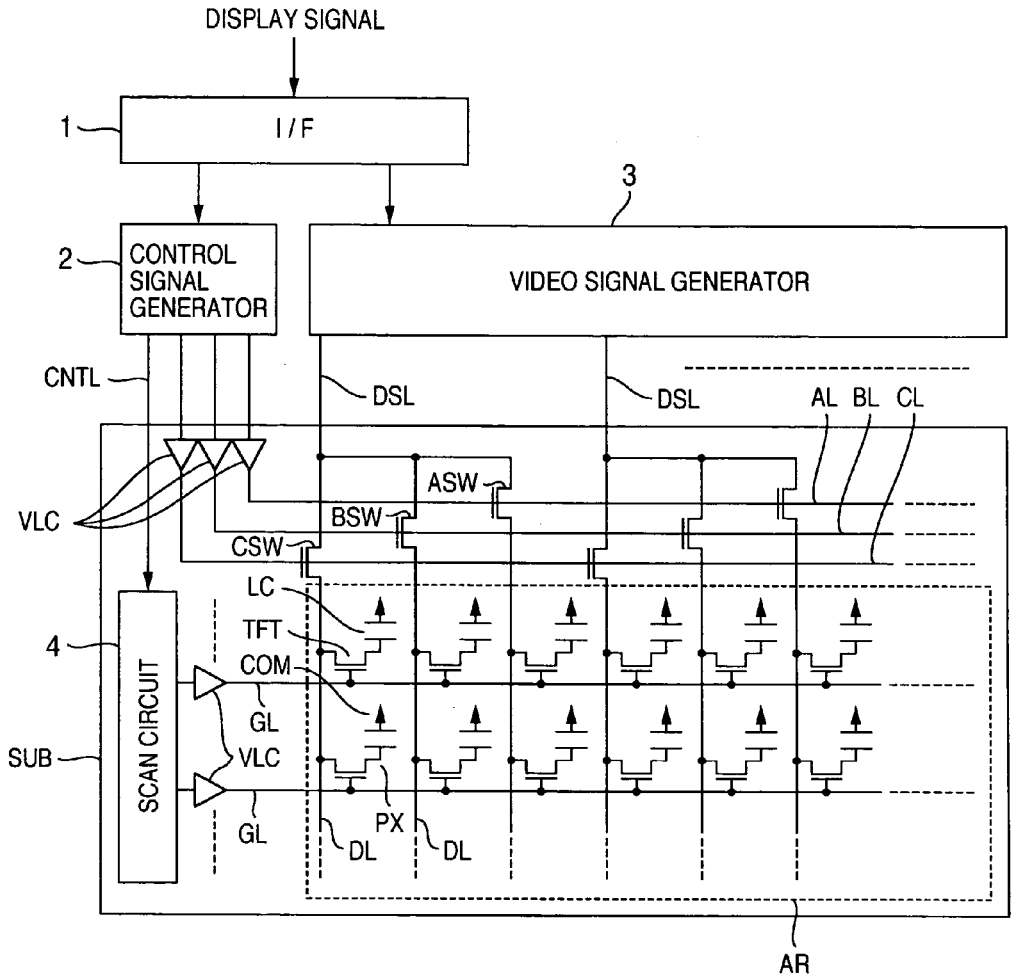
FIG. 1 schematically shows a liquid crystal display device in accordance with the present invention.

FIG. 1 schematically shown an entire arrangement of a liquid crystal display device in accordance with the present invention, wherein a pair of transparent insulating substrates (such as glass substrates) are arranged to be opposed to each other with a liquid crystal disposed therebetween and one of the transparent insulating substrates is denoted by SUB. A display area AR is provided in a central part of a liquid-crystal side surface of the transparent insulating substrate SUB other than its periphery.

A plurality of gate signal lines GL extended in an x direction and arranged parallelly in a y direction as well as a plurality of drain signal lines DL extended in the y direction and arranged parallelly in the x direction in FIG. 1 are formed in the display area AR.

In this example, a zone surrounded by the adjacent two gate signal lines GL and by the adjacent two drain signal lines DL forms a pixel zone. The pixel zone includes a thin film transistor TFT operated by a scan signal supplied from one of the two gate signal lines GL and a pixel electrode PX having a video signal supplied from one of the two drain signal lines DL via the transistor TFT.

In other words, the scan signal (voltage) is supplied to the gate signal lines GL sequentially from their upper line to the lower one to turn ON the transistor TFT. At this timing, the video signal (voltage) is supplied from each drain signal line DL and applied to the pixel electrode PX via the turned-ON transistor TFT.

Each pixel electrode PX is arranged, for example, so as to generate an electric field between the pixel electrode PX and a counter electrode COM on a liquid-crystal side surface of the other of the opposing transparent insulating substrates SUB, and so as to cause the electric field to control the light transmissivity of a liquid crystal LC.

The peripheral circuits of the display area AR will be briefly explained. The gate signal lines GL are connected via the voltage level converters VLC to a scan circuit 4 having, e.g., a shift register. Under control of the scan circuit 4, the scan signal is supplied sequentially to the gate signal lines GL.

The drain signal lines DL, on the other hand, are connected via video signal distribution switches ASM, BSW, and CSW to each video signal line DSL.

Each video signal distribution switch is made of, e.g., an MIS transistor. The transistor in turn has a gate terminal connected to switch control signal lines AL, BL, and CL, has a first terminal connected to the drain signal line DL, and also has a second terminal connected to the video signal line DSL.

The video signal line DSL is connected to a video signal generator 3. The switch control signal lines AL, BL, and CL are connected to a control signal generator 2 via the respective voltage level converters VLC.

Explanation will be made as to the operation of each section in the liquid crystal display device of FIG. 1 according to a flow of a display signal (including display and a synchronization signal) externally input.

An external display signal is input to an interface (I/F) 1. The I/F 1 in turn outputs a timing signal based on a synchronization signal to the control signal generator 2, and also outputs display data sequentially to the video signal generator 3.

The control signal generator 2 outputs a control signal (such as clock signal or start signal) for the scan circuit 4 to a control signal line CNTL on the basis of the timing signal. The scan circuit 4, on the basis of the control signal, sequentially outputs the scan signal to the gate signal lines GL.

Meanwhile, the control signal generator 2 outputs a select signal to the switch control signal lines AL, BL, and CL via the voltage level converters VLC in such a manner that, while the scan circuit 4 outputs the scan signal to any gate signal line GL to turn ON the transistor TFT, the video signal distribution switches ASM, BSW, and CSW are sequentially selected on a time division basis.

At this time, the video signal generator 3 sequentially outputs the video signal to the corresponding drain signal line DL via one of the video signal distribution switches ASM, BSW, and CSW selected on the time division base.

As has been explained above, such voltage level converters VLC are provided at locations which require voltage level conversion. More specifically, the voltage level converter VLC is provided respectively between the control signal generator 2 and the video signal distribution switches ASM, BSW, CSW. The voltage level converter VLC is also provided respectively between the scan circuit 4 and the gate signal lines GL.

The display area AR formed on the transparent insulating substrate SUB and circuits peripheral thereto (the scan circuit 4, the video signal distribution switches ASM, BSW, CSW, and the voltage level converters VLC in FIG. 1) are made of thin film transistors (MIS TFTs), pixel electrodes, signal lines and so on formed by laminating a conductive layer having a predetermined pattern, a semiconductor layer, an insulating layer and so on, selectively etched by a photolithography technique. In this case, the semiconductor layer is made of, for example, polycrystalline silicon (p-Si).

In FIG. 1, the I/F 1, the control signal generator 2, and the video signal generator 3 are not formed on the transparent insulating substrate SUB. However, these circuits may be formed on the transparent insulating substrate SUB like the scan circuit 4, and their circuit arrangements are not limited to an example shown in FIG. 1.

Further, the installation locations of the voltage level converters VLC are not restricted to such locations as shown in FIG. 1, but can be provided at locations requiring level conversion or at other locations.

An embodiment of the voltage level converter VLC shown in FIG. 1 will be explained by referring to FIGS. 2, 3, and 4.

Figure 2:
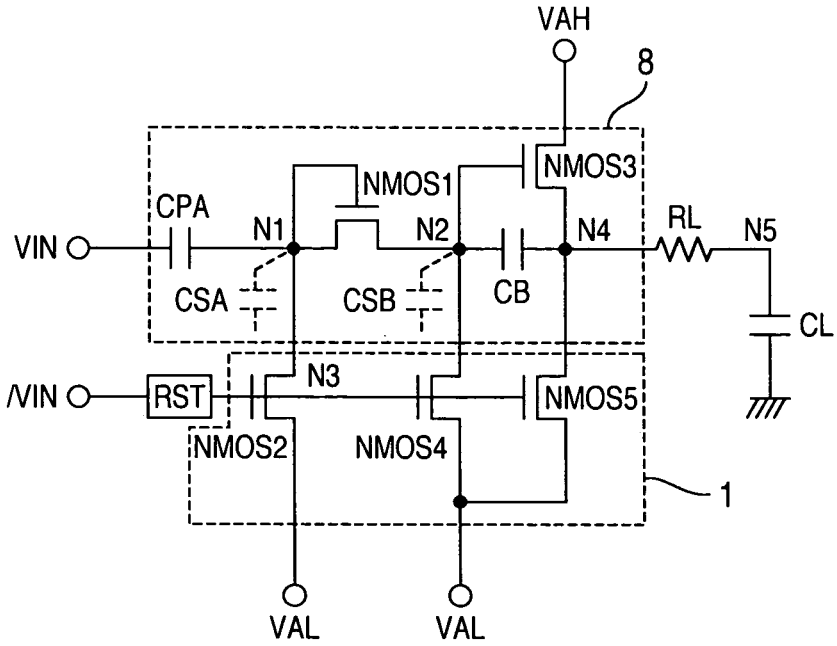
FIG. 2 shows a circuit arrangement of a voltage level converter VLC in FIG. 1.

FIG. 2 shows a circuit diagram of an embodiment of the voltage level converter VLC. In the drawing, an input terminal of an input pulse VIN is connected to one terminal of a capacitance CPA, and the other terminal of the capacitance CPA is connected to a gate terminal of an n type MOS transistor NMOS1 as a MIS TFT and a first terminal (referring to one of source and drain terminals) thereof, and also to a first terminal of an n type MOS transistor NMOS2 as a MIS TFT, which interconnection forms a node N1.

A second terminal (referring to the other of the source and drain terminals) of the transistor NMOS1 is connected to a gate terminal of an n type MOS transistor NMOS3 as a MIS TFT, to a first terminal of an n type MOS transistor NMOS4 as a MIS TFT and also to one terminal of a capacitance CB, which interconnection forms a node N2.

The other terminal of the capacitance CB is connected to a second terminal of the transistor NMOS3 and to a first terminal of an n type MOS transistor NMOS5 as a MIS TFT, which interconnection forms a node N4.

An input terminal for an input pulse /VIN ("/" in /VIN referring to a bar and meaning a pulse corresponding to an inversion of the input pulse VIN) is connected to an input terminal of a reset signal generating circuit RST. An output terminal of the reset signal generating circuit RST is connected to gate terminals of the transistors NMOS2, NMOS4, and NMOS5, which interconnection forms a node N3.

A second terminal of the transistor NMOS3 is connected to a high voltage power supply line VAH. A second terminal of the transistor NMOS4 and a second terminal of the transistor NMOS5 are connected to a low voltage power supply line VAL. A second terminal of the transistor NMOS2 is connected also the line VAL. In this connection, VAH and VAL also refer to line names and line potentials.

In the voltage level converter VLC shown in FIG. 2, the node N4 forms an output terminal. In the illustrated example, a load resistance RL and a load capacitance CL are connected in series between the output terminal (N4) as resistance and capacitance loads and the ground. A connection point between the load resistance RL and the load capacitance CL forms a node N5. The voltage level converter VLC for driving the load resistance RL and the load capacitance CL includes a charge circuit 6, a discharge circuit 7, and the reset signal generating circuit RST. The charge circuit 6 has the capacitance CPA and the transistors NMOS1 and NMOS3. The discharge circuit 7 has the transistors NMOS2, NMOS4, and NMOS5.

A capacitance CSA shown by a dashed line in FIG. 2 indicates a parasitic capacitance including the wiring capacitance of the node N1 and the gate capacitance of the transistor NMOS1, present except for the capacitance CPA. Similarly, a capacitance CSB shown by a dashed line indicates a parasitic capacitance including the wiring capacitance of the node N2 and the gate capacitance of the transistor NMOS3, present except for the capacitance CB.

Figure 3:
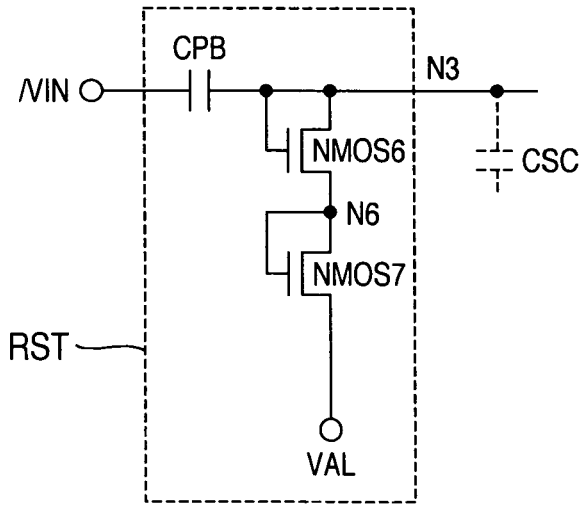
FIG. 3 shows a circuit arrangement of a reset signal generating circuit RST shown in FIG. 2.

FIG. 3 shows a circuit arrangement of an embodiment of the reset signal generating circuit RST shown in FIG. 2, wherein the input terminal for the input pulse /VIN is connected to one terminal of a capacitance CPB.

The other terminal of the capacitance CPB is connected to a gate terminal of an n type MOS transistor NMOS6 and a first terminal thereof, and further connected to an output terminal of the reset signal generating circuit RST, which interconnection forms the node N3 in FIG. 2.

A second terminal of the transistor NMOS6 is connected to a gate terminal of an n type MOS transistor NMOS7 and a first terminal thereof, which interconnection forms a node N6. A second terminal of the transistor NMOS7 is connected to the low voltage power supply line VAL. In this connection, the transistor NMOS7 may be omitted.

A capacitance CSC shown by a dashed line in FIG. 3 indicates a parasitic capacitance including the wiring capacitance of the node N3 and the gate capacitances of the transistors NMOS2, MNOS4, and NMOS5, present except for the capacitance CPB.

Figure 4:
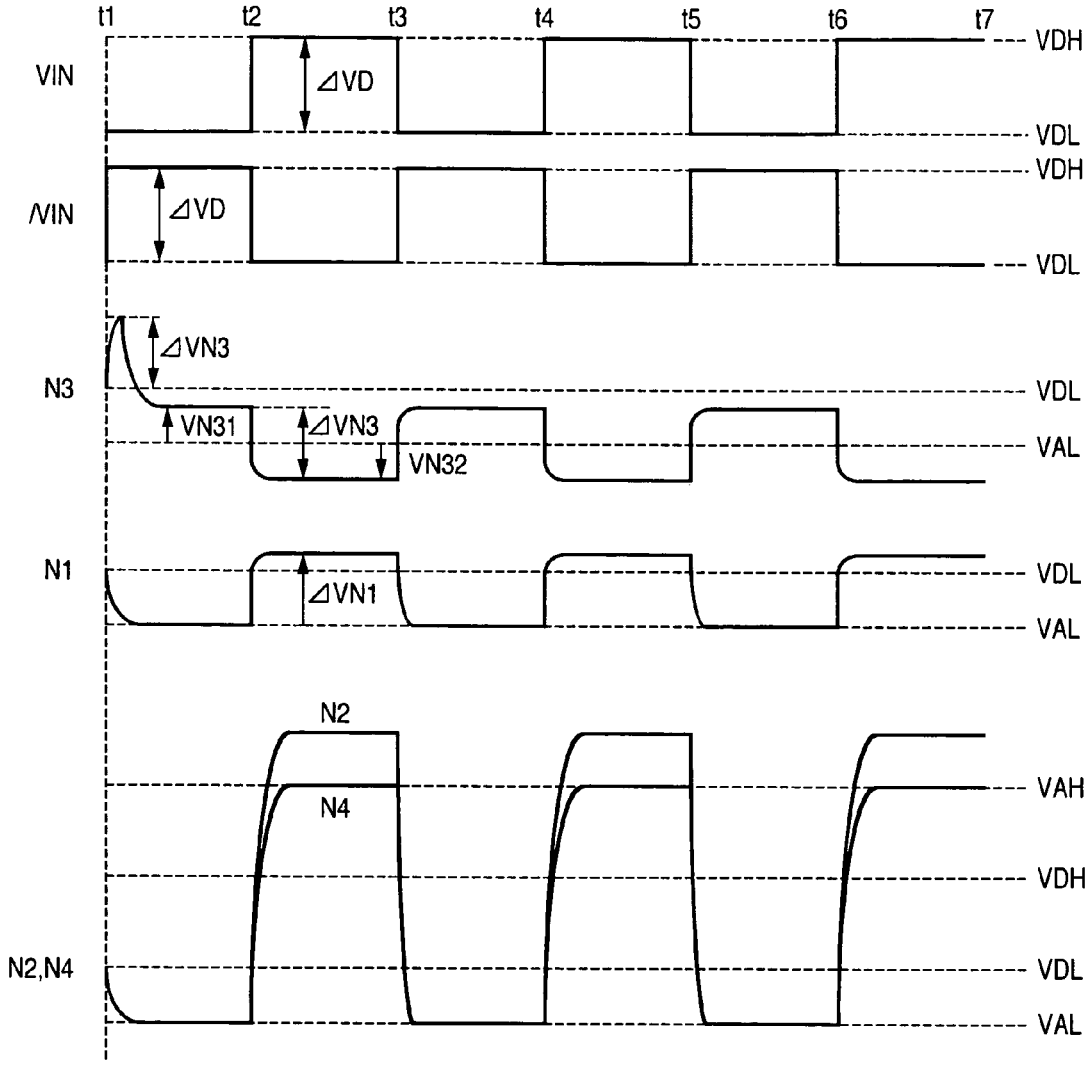
FIG. 4 is a timing chart showing the operation of the voltage level converter VLC in the present invention.

Explanation will next be made as to the operation of the aforementioned voltage level converter VLC, by using FIG. 4 showing waveforms of the input pulses VIN and /VIN and waveforms of signals appearing at the nodes (N1, N2, N3 and N4) shown in FIG. 2.

Assume first that the maximum and minimum potentials or levels of the input pulses VIN and /VIN are denoted by VDH and VDL respectively. It is also assumed that the maximum voltage VDH of the input pulse is half of the high voltage power supply line VAH, and is expressed by an equation (1) which follows.

$$VDH=VAH/2 \tag{1}$$

Assuming that the input pulses VIN and /VIN have an amplitude voltage ΔVD, then the amplitude voltage is expressed by the following equation (2). Assume further that the n type MOS transistors NMOS1 to NMOS6 have the same threshold voltage Vth.

$$\Delta VD=VDH-VDL \tag{2}$$

It is also assumed that a relation shown by the following equation (3) is satisfied between the threshold voltage Vth and other potentials, the minimum potential VDL of the input pulse is not smaller than the low voltage power supply potential VAL, and the following equation (4) is satisfied.

$$Vth=VAH/6=VDH/3 \tag{3}$$

$$VDL-VAL>Vth \tag{4}$$

In this connection, the conditions of the equations (1), (3), and (4) are used only for the purpose of simplification of explanation to be explained below, and actual conditions are not limited to the above conditions.

It is assumed in FIG. 4 that, in an initial state, the input pulses VIN and /VIN and the potentials at the nodes (N1 to N6) in FIGS. 2 and 3 are at VDL. Explanation will first be made as to the operation of the converter when the level of the input pulse /VIN is changed from a low (referred to merely as L) level to a high (referred to merely as H) level at a time point t1.

The input pulse /VIN is capacitively coupled with the node N3 by the capacitance CPB in the reset signal generating circuit RST. For this reason, a voltage change ΔVD in the input pulse /VIN causes a potential at the node N3 to be changed. Assuming that the potential is changed by an amount ΔVN3 at this time, then ΔVN3 is generally expressed by the following equation (5). In the equation, CSC denotes a parasitic capacitance when CPB denotes an effective capacitance at the node N3, as already explained above.

$$\Delta VN3=\Delta VD\times CPB/(CPB+CSC) \tag{5}$$

In the vicinity of the time point t1, the potential at the node N3 is changed from VDL to about ΔVN3. Hence, when a difference between the potential of the node N3 and VAL is denoted by V(N3, VAL), the difference is generally expressed by the following equation (6).

$$V(N3,VAL)=\Delta VN3+VDL-VAL \tag{6}$$

At this time, if V(N3, VAL) is twice larger than Vth, then the transistors NMOS6 and NMOS7 diode-connected are both turned ON. The then voltage relation is expressed by the following equation (7).

$$V(N3,VAL)=\Delta VN3+VDL-VAL>2\times Vth \tag{7}$$

Finding the then ΔVN3 requirement from the equations (4), (5) and (7) results generally in.

$$\Delta VN3>Vth \tag{8}$$

When the equation (7) is satisfied, the transistors NMOS6 and NMOS7 are both turned ON so that the potential at the node N3 is changed toward the low voltage power supply line potential VAL. Thereafter, the potential at the node N3 is lowered until the transistors NMOS6 and NMOS7 are clipped.

At this time, a potential difference VN31 between the node N3 and VAL is expressed as follows.

$$VN31=2\times Vth \tag{9}$$

Since a voltage larger than the threshold voltage Vth is applied between the gate terminals (node N3) of the transistors NMOS2, NMOS4, NMOS5 and the second terminals thereof (VAL supply terminal), the respective transistors NMOS are turned ON. Accordingly, potentials at the nodes N1, N2 and N4 connected to the first terminals of the transistors NMOS2, NMOS4, and NMOS5 are converged to VAL.

Explanation will then be made as to the operation of the converter when the input pulse /VIN is changed from H level to L level and when the input pulse VIN is changed from L level to H level at a time point t2.

The change of the input pulse /VIN from H level to L level causes the potential at the node N3 capacitively coupled by the capacitance CPB to change by an amount ΔVN3 in a direction toward the low potential as mentioned above. Hence at this time, from the equation (9), a potential difference VN32 between the node N3 and VAL satisfies an equation (10) which follows.

$$VN32=2\times Vth-\Delta VN3<Vth \quad (10)$$

Thus, the transistors NMOS6 and NMOS7 keep their OFF state. Since a potential difference between the gate terminals (node N3) of the transistors NMOS2, NMOS4, NMOS5 and the second terminals (VAL supply terminal) thereof is smaller than the threshold voltage Vth; the transistors NMOS2, NMOS4, and NMOS5 are turned OFF.

The input pulse VIN is capacitively coupled with the node N1 by the capacitance CPA. For this reason, the potential of the node N1 is changed by the amount ΔVD of the input pulse VIN. A potential change ΔVN1 at this time is generally expressed as follows.

$$\Delta VN1=\Delta VD\times CPA/(CPA+CSA) \quad (11)$$

In the equation, CSA denotes a parasitic capacitance for the node N1 when CPA denotes an effective capacitance, as already explained above. The input pulse /VIN is changed to H level to L level to turn OFF the transistors NMOS2, NMOS4, NMOS5 at the time point t2. Thus the change of the input pulse VIN from L level to H level causes the potential at the node N1 to be increased from VAL to ΔVN1.

The node N2 is charged up to a potential lower by the threshold voltage Vth through the transistor NMOS1. The then potential difference V (N2, VAL) between the node N2 and VAL is expressed as follows.

$$V(N2,VAL)=\Delta VN1-Vth \quad (12)$$

At this time, when V (N2, VAL) is larger than Vth, the transistor NMOS3 is also turned ON and thus the potential of the node N4 starts to rise. Since the node N4 is connected to a load circuit including the load resistance RL, the node N5, and the load capacitance CL at this time; the potential rise at the node N4 is assumed to be slower than the potential rise at the node N2.

Assuming that the potential difference V(N2, VAL) of the node N2 satisfies the equation (12), V(N2, VAL) when the transistor NMOS1 is cut off is VCB0, and a potential difference at this time between the node N4 and VAL is VN40, then the following equation (13) is satisfied.

$$VCB0=V(N2,VAL)-VN40=\Delta VN1-Vth-VN40>Vth \quad (13)$$

A ΔVN1 requirement is derived from the equation (13) as follows.

$$\Delta VN1>2\times Vth+VN40 \quad (14)$$

In this case, even when the transistor NMOS1 is cut off, the transistor NMOS3 is kept in the ON state and thus the potential at the node N4 increases toward VAH through the transistor NMOS3.

When the node N4 has a potential change ΔVN4 thereafter, the node N2 has a potential of (ΔVN1−Vth)+CB/(CB+CSB)×ΔVN4. Since the node N4 has a potential of VN40+ΔVN 4, a potential difference ΔVCB between the nodes N2 and N4 is generally expressed as follows.

$$\Delta VCB=\Delta VN1-Vth+\Delta VN4\times CB/(CB+CSB)-(VN40+\Delta VN4) \quad (15)$$

-continued $$=(\Delta VN1-Vth-VN40)+\Delta VN4\times CB/(CB+CSB)-\Delta VN4)$$

$$=VCB0+\Delta VN4\times CB/(CB+CSB)-\Delta VN4$$

A symbol CSB in the equation denotes a parasitic capacitance for the node N2 when the capacitance CB is an effective capacitance. In this case, so long as the equation (15) satisfies an equation (16) which follows, the transistor NMOS3 is put in the ON state so that an electric charge is supplied from the high voltage power supply line VAH to the node N4.

$$\Delta VCB=VCB0+\Delta VN4\times CB/(CB+CSB)-\Delta VN4>Vth \quad (16)$$

Accordingly, in order for the node N4 to be changed up to VAH, it is only required to satisfy an equation (17) which follows.

$$VCB0+(VAH-VN40)\times CB/(CB+CSB)-(VAH-VN40)>Vth \quad (17)$$

The essence of the circuit of the present embodiment is that a voltage rise at the node N4 is slower than a voltage rise at the node N2 and, at this time, that the transistors NMOS2, NMOS4, and NMOS5 connected with VAL are put in the OFF state. In other words, it is necessary to set circuit constants, in particular, the sizes and coupling capacitances of the transistors so as to realize such operation.

The above explanation has been made in connection with the case where the threshold voltage Vth is always constant. However, when a change in the threshold voltage to fluctuations in respective voltages cannot be ignored due to substrate effects, etc., it is necessary to use the then threshold voltage Vth.

Explanation will next be made as to the operation of the converter when the input pulse VIN is changed from H level to L level and when the input pulse /VIN is changed from L level to H level at a time point t3. In this case, the potential of the node N3 is varied by the capacitance CPB and the then variation ΔVN3 is expressed by the equation (5).

At this time, a potential difference VN31 between the node N3 and VAL is generally expressed by the equation (9). This causes the transistors NMOS2, NMOS4, and NMOS5 to be turned ON, whereby the nodes N1, N2, and N4 are discharged to VAL.

At a time point t4 and subsequent time points, the aforementioned operations are repeated to repeat the voltage level conversion.

In the present embodiment of FIG. 3, two of the transistors NMOS are provided. However, the single transistor NMOS may be employed or the number of such transistors NMOS is not limited to one or two.

In the latter case, it is only required to make a potential difference between the node N3 and VAL clipped by a diode included in the reset signal generating circuit RST of FIG. 3 larger than the threshold voltage of the transistors NMOS2, NMOS4, and NMOS5 shown in FIG. 2, and to make a potential difference between the node N3 and VAL after the change of the input pulse /VIN from H level to L level smaller than the threshold voltage of the transistors NMOS2, NMOS4, and NMOS5.

Although the second terminal of the transistor NMOS2 is connected to VAL in FIG. 2 of the present embodiment, the connected potential is not limited to VAL and may be, for example, VDL. In this case, however, it is necessary to set constants in such a manner that no through current flows through the transistor NMOS1 during the ON state of the both transistors NMOS2 and NMOS4. If it is unnecessary to pay consideration to the through current, then the present invention is not limited to the above setting.

Figure 5A:
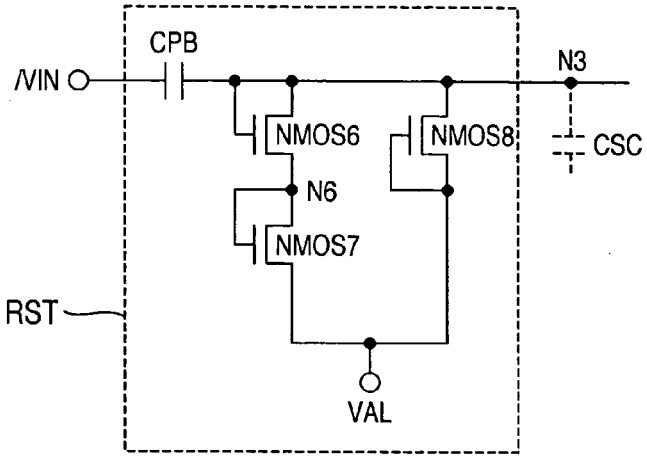
FIG. 5A shows another circuit arrangement of the reset signal generating circuit RST in the present invention.

FIG. 5A shows another circuit arrangement of the reset signal generating circuit RST included in the voltage level converter of FIG. 2 as another realizing means. In the circuit arrangement shown in FIG. 5A, components having the same functions as those in the reset signal generating circuit RST of FIG. 3 are denoted by the same reference symbols, and explanation thereof is omitted.

The reset signal generating circuit RST of FIG. 5A, when compared with the reset signal generating circuit RST of FIG. 3, has an additional n type MOS transistor NMOS8. A first terminal of the transistor NMOS8 is connected to the node N3, and second and gate terminals thereof are connected to VAL. In this connection, an n type MOS transistor may be additionally provided to the second and gate terminals of the transistor NMOS8. Or no transistor addition may be made and the transistor NMOS7 may be omitted.

Figure 5B:
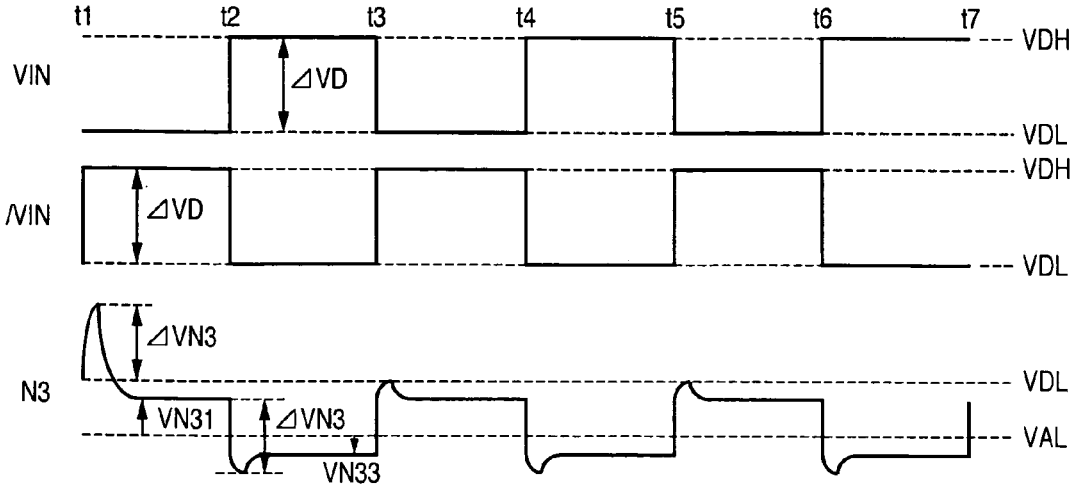
FIG. 5B is a timing chart showing the operation of the reset signal generating circuit RST of FIG. 5A.

The waveform of a voltage at the node N3 generated by the reset signal generating circuit RST of FIG. 5A will be explained by using FIG. 5B.

The operation of the reset signal generating circuit of FIG. 5A during a period between the time points t1 and t2 is nearly the same as the operation of the reset signal generating circuit RST of FIG. 3, and the potential of the node N3 is clipped by a potential difference VN31 between the transistor NMOS6 and NMOS7 diode-connected.

At this time, since the diode-connected transistor NMOS8 is reversely biased, only an OFF current flows therethrough and thus a potential difference between the node N3 and VAL is about VN31.

When the input pulse /VIN is changed from H level to L level at the time point t2, the node N3 capacitively coupled by the capacitance CPB is subjected to a potential variation, which variation ΔVN3 is expressed by the equation (5).

At this time, when the following equation (18) is satisfied, the diode-connected transistor NMOS8 is turned ON, so that the potential of the node N3 is increased toward VAL until the potential is clipped by the transistor NMOS8.

$$\Delta VN3-2\times Vth>Vth \tag{18}$$

A potential difference VN33 between the node N3 and VAL when the potential is clipped is expressed as follows.

$$VN33=-Vth \tag{19}$$

When the equation (18) is not satisfied, the transistor NMOS8 is turned OFF with the same operation as that of FIG. 3. As has been explained above, since a potential lower than VAL is applied to the node N3 or a voltage not larger than the threshold voltage Vth is applied to the node N3, the transistors NMOS2, NMOS4, and NMOS5 are put in the OFF state.

Since the diode-connected transistors NMOS6 and NMOS7 are reversely biased, further, these transistors are put in the OFF state. Accordingly, even when the reset signal generating circuit RST of FIG. 5A is used, the voltage level converter VLC of FIG. 2 can be realized similarly to the case of use of FIG. 3.

Like FIG. 3, further, the number of transistors NMOS diode-connected is not limited even in FIG. 5A. For example, when an n type MOS transistor NMOS9 (not shown) is added to the transistor NMOS8, it is only required to connect a first terminal of the transistor NMOS9 to the second and gate terminals of the transistor NMOS8 and to connect second and gate terminals of the transistor NMOS9 to VAL. In addition, the transistor NMOS7 may be removed and the node N6 of the transistor NMOS6 may be connected to VAL.

At this time, constants may be designed so that the nodes N1, N2, and N4 are discharged to VAL during the ON state of the transistors NMOS2, NMOS4, and NMOS5 after the input pulse /VIN is changed from L level to H level until the potential of the node N3 is clipped.

Figure 6A:
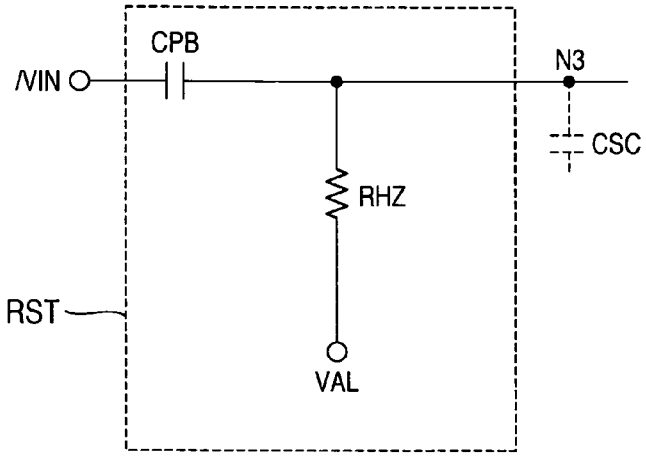
FIG. 6A is a further circuit arrangement of the reset signal generating circuit RST.

Next, FIG. 6A shows a further circuit arrangement of the reset signal generating circuit RST included in the voltage level converter of FIG. 2 as a further realizing means. In the circuit arrangement of FIG. 6A, components having the same functions as those in the reset signal generating circuit RST of FIG. 3 are denoted by the same reference symbols, and explanation thereof is omitted.

Figure 6B:
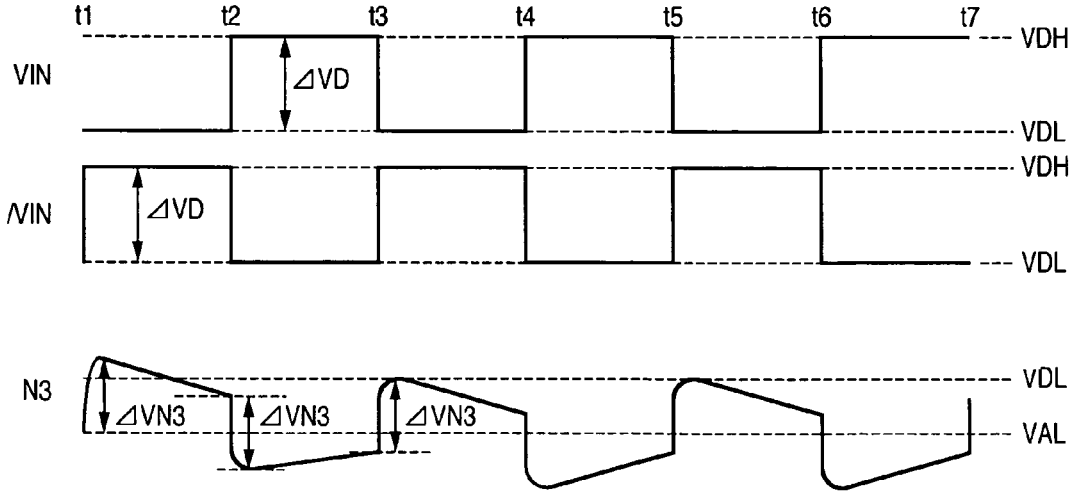
FIG. 6B is a timing chart showing the operation of the reset signal generating circuit RST of FIG. 6A.

In the reset signal generating circuit RST of FIG. 6A, the node N3 is connected to VAL through a high resistance RHZ. FIG. 6B shows the waveform of a voltage appearing at the node N3 when the reset signal generating circuit RST of FIG. 6A is used. In the drawing, the node N3 is assumed to have an initial potential VAL.

When the input pulse /VIN is changed from L level to H level at a time point t1, the node N3 capacitively coupled by the capacitance CPB varies toward a high potential side by an amount ΔVN3 shown by the equation (5).

Thereafter, the potential of the node N3 is changed toward VAL according to a time constant determined by the high resistance RHZ and the capacitances CPB, CSC.

After that, at a time point t2, the potential is changed by ΔVN3 toward the low potential side in order for the input pulse /VIN to change from H level to L level.

The above operation is repeated so that the voltage waveform of the node N3 becomes an AC waveform having VAL nearly at its DC potential (central potential).

When constants are designed so that, when the input pulse /VIN is changed from L level to H level, the nodes N1, N2 and N4 are sufficiently discharged to VAL during a period wherein the potential of the node N3 is higher than the threshold voltage Vth of the transistors NMOS2, NMOS4 and NMOS5; effects similar to those of the reset signal generating circuit RST of FIG. 3 can be obtained.

When the input pulse /VIN is now changed from H level to L level; the transistors NMOS2, NMOS4 and NMOS5 is required to be put in the OFF state, which will be obvious from the above explanation.

Embodiment 2

Explanation will be made as to embodiment 2 of the present invention to realize the voltage level converter VLC in the liquid crystal display device of FIG. 1.

Figure 7:
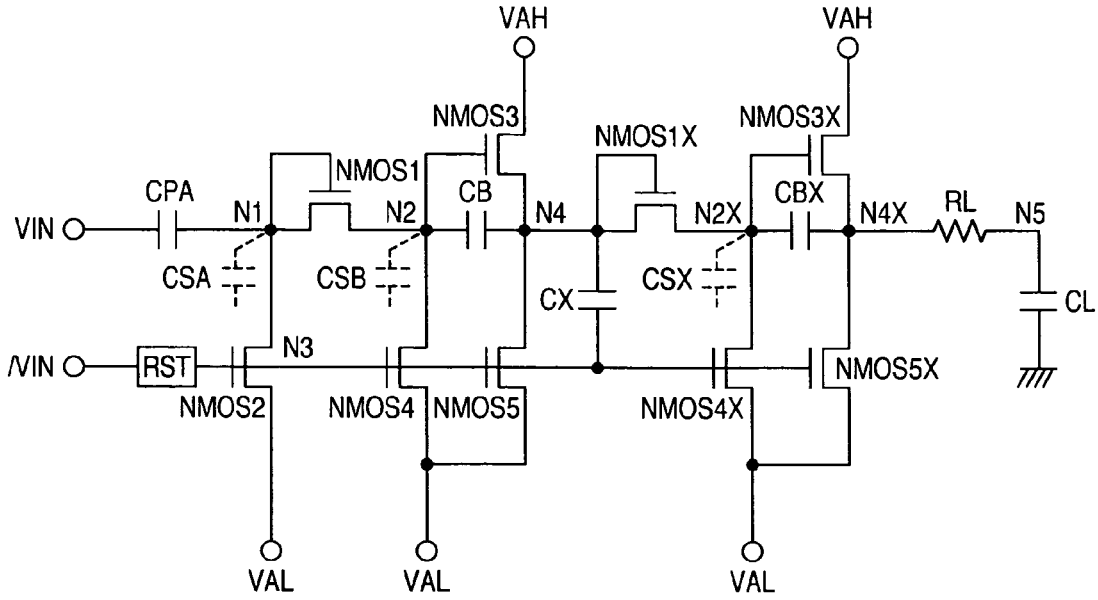
FIG. 7 is another circuit arrangement of the voltage level converter VLC in the present invention.

FIG. 7 shows a circuit arrangement of the voltage level converter VLC in accordance with the present embodiment. The voltage level converter VLC of the present embodiment corresponds to two of the voltage level converters of FIG. 2 connected to each other.

The first stage in the voltage level converter VLC of FIG. 7 has the same arrangement as that of the voltage level converter circuit of the embodiment 1 of FIG. 2, and thus explanation thereof is omitted.

In the second stage in the voltage level converter, no capacitance corresponding to the capacitance CPA in the first stage of voltage level converter circuit is provided, a signal at the node N4 as the output signal of the first stage of voltage level converter circuit corresponds to the input signal of the second stage of voltage level converter circuit, and the input signal of the second stage is connected to first and gate terminals of an n type MOS transistor NMOS1X corresponding to the transistor NMOS1 in the first stage of voltage level converter circuit.

In the second stage of voltage level converter circuit, a transistor corresponding to the transistor NMOS2 in the first stage is not provided because the transistor NMOS5 in the first stage plays a similar role thereto.

Further, since the reset signal generating circuit RST is shared by the first- and second-stage of voltage level converter circuits, the gate terminal of an n type MOS transistor NMOS4X corresponding to the transistor NMOS4 in the first stage and the gate terminal of an n type MOS transistor NMOS5X corresponding to the transistor NMOS5 in the first stage are connected to the node N3.

In this example, the node N4 as the output terminal of the first stage is capacitively coupled with the node N3 by a capacitance CX.

The second terminal of the transistor NMOS1X is connected to the gate terminal of an n type MOS transistor NMOS3X corresponding to the transistor NMOS3 in the first stage, to one terminal of a capacitance CBX corresponding to the capacitance CB in the first stage, and also to the first terminal of the transistor NMOS4X, which interconnection forms a node N2X.

The first terminal of the transistor NMOS3X is connected to the other terminal of the capacitance CBX and also to the first terminal of the transistor NMOS5X, which interconnection forms a node N4X. The second terminals of the transistors NMOS4X and NMOS5X are connected to the low voltage power supply line VAL, and the second terminal of the transistor NMOS3X is connected to the high voltage power supply line VAH.

In this example, the node N4X forms the output terminal of the voltage level converter of the present embodiment; and the output terminal is connected with a load circuit including the load resistance RL, the node N5, and the load capacitance CL.

A capacitance CSX is a parasitic capacitance for the node N2X when the capacitance CBX is an effective capacitance. Thus the second stage of voltage level converter circuit corresponds, in circuit arrangement, to the first stage of voltage level converter circuit, but is different therefrom in that the capacitance CPA and the transistor NMOS2 and a component corresponding to the reset signal generating circuit RST in the first stage of voltage level converter circuit are omitted.

Figure 8A:
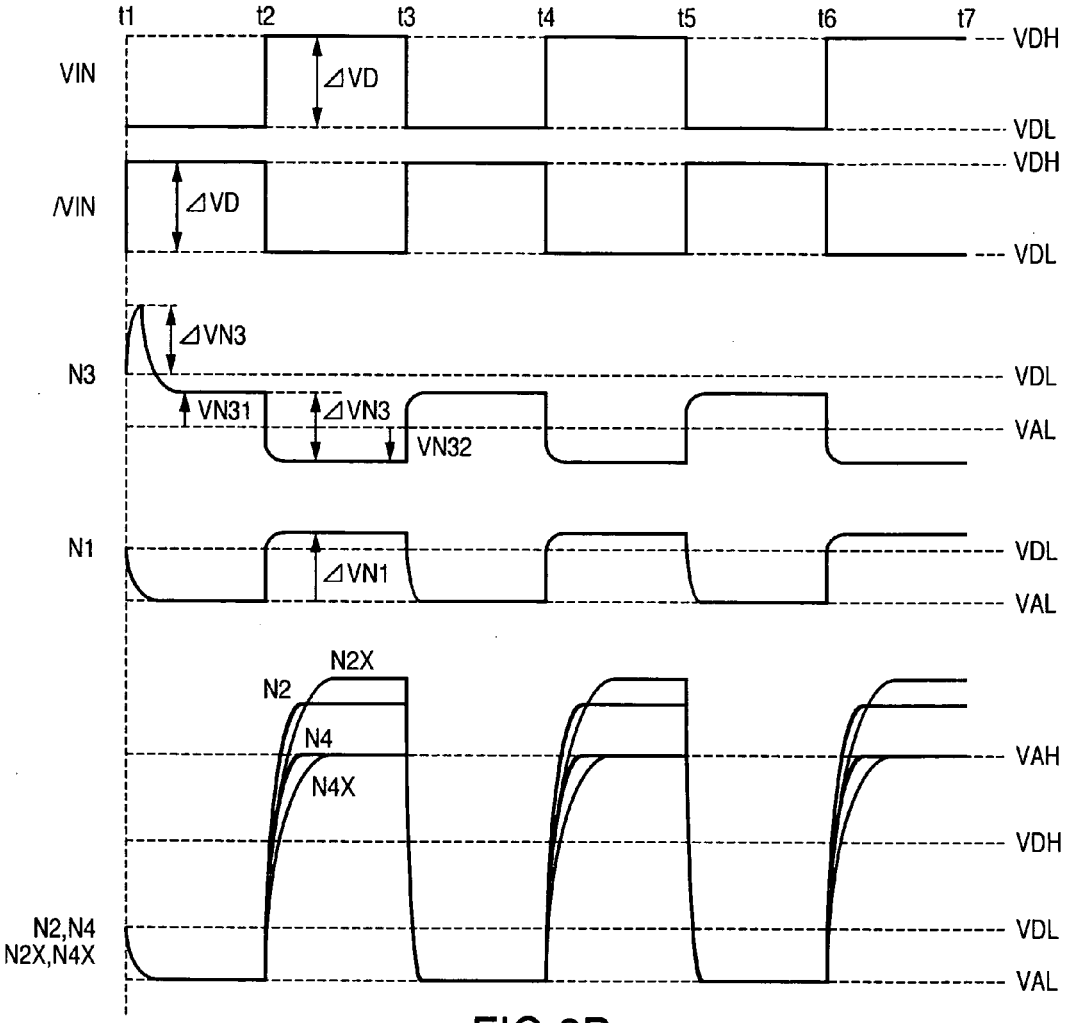
FIG. 8A is a timing chart showing the operation of the voltage level converter VLC of FIG. 7.
Figure 8B:
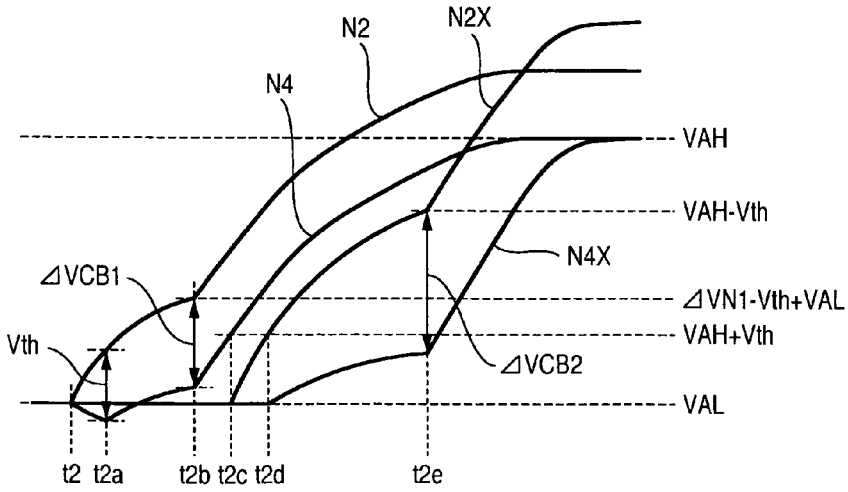
FIG. 8B shows voltage waveforms with voltage levels.

FIG. 8A is a timing chart showing the operation of the voltage level converter VLC of FIG. 7, and FIG. 8B shows waveforms of potentials appearing at the nodes N2, N4, N2X, and N4X.

The operation of the voltage level converter VLC of FIG. 7 will be explained by referring to FIG. 8. Since the first stage circuit in the voltage level converter VLC of FIG. 7 has the same arrangement as the voltage level converter VLC of FIG. 2 already explained above, the operation of the first stage circuit has been already explained in connection with FIG. 4 of the embodiment 1.

Accordingly, when the input pulse /VIN is changed from L level to H level at the time point t1, the transistors NMOS (NMOS2, NMOS4, NMOS5, NMOS4X, and NMOS5X) having the respective gate terminals connected to the node N3 are turned ON, with the result that the potentials at the nodes N2, N4, N2X, and N4X connected to the first terminals of the transistors NMOS are changed to VAL.

Thereafter, at the time point t2, when the input pulse /VIN is changed to H level to L level, the transistors NMOS having their gate terminals connected to the node N3 are turned OFF.

Meanwhile, at the time point t2, the input pulse VIN is changed from L level to H level. Thus as has been explained in the embodiment 1, when the equation (17) is satisfied, the potential of the node N4 increases up to VAH.

In the voltage level converter of the present embodiment, the node N4 is capacitively coupled with the node N3 by the capacitance CX. Thus when the potential of the node N3 is changed to the lower potential side at the time point t2 as shown in FIG. 8B, this causes the potential of the node N4 to once transit to the lower potential side.

When a potential difference between the nodes N2 and N4 becomes Vth at a time point t2*a*, the transistor NMOS3 is turned ON so that the potential of the node N4 starts to rise toward VAH through the transistor NMOS3.

Thereafter, when a potential difference between the node N2 and VAL satisfies the relation shown by the equation (13) at a time point t2*b*, the transistor NMOS1 is cut off.

The then potential difference between the nodes N2 and N4 is denoted by ΔVCB1. When the potential difference ΔVCB1 satisfies an equation (20) which follows similarly to the equation (17), the potential of the node N4 increases up to VAH.

$$VCB1+(VAH-VN40)\times CB/(CB+CSB)-(VAH-VN40)>Vth \quad (20)$$

In the present embodiment, the node N4 is capacitively coupled with the node N3 by the capacitance CX, as already explained above. Therefore, when compared with the voltage level converter of the embodiment 1, a larger voltage is applied between the node N2 leading to the gate terminal of the transistor NMOS3 and the node N4 leading to the first terminal thereof. As a result, a rate at which the node N4 increases to VAH becomes faster.

When the potential increasing rate of the node N4 is not significant, the capacitance CX can be omitted. A time constant relating to the potential increasing rate of the node N4 is generally given by an equation (21) which follows.

$$\tau(t)=RON(t)(NMOS3)\times CNMOS3 \quad (21)$$

In the above equation, CNMOS3 denotes a load capacitance for the transistor NMOS3, and RON(t)(NMOS3) denotes an ON resistance for the transistor NMOS3. A time constant τ is expressed by a time function.

This is because the ON resistance of the transistor NMOS3, that is, an effective current value varies with time. A current Ids at a rising part of NMOS3 at the time point t2 is generally expressed as follows.

$$Ids=A\times(\Delta VCB1-Vth)\times(\Delta VCB1-Vth) \quad (22)$$

In the above equation, A denotes a constant determined by the structure, dimensions, etc. of the MOS transistor. Since the ON resistance RON is inversely proportional to the current Ids, it will be seen from the equations (21) and (22) that ΔVCB1 is determined mainly by the time constant τ.

That is, the larger ΔVCB1 is, the smaller the ON resistance RON is, the smaller the time constant τ is, and the faster the potential increasing rate of the load circuit is.

In the present embodiment, a signal from the output node N4 of the first stage of voltage level converter circuit is used as an input signal for the second stage of voltage level converter circuit, as has been explained above. Therefore, as shown in FIG. 8B, the potential at the node N4 starts to increase, a potential difference between the nodes N4 and N2X at a time point t2*c* becomes Vth or higher, and the node N2X starts to be charged through the diode-connected transistor NMOS1X.

Thereafter, at a time point t2*d*, a potential difference between the nodes N2X and N4X becomes Vth or higher and the transistor NMOS3X is turned ON, whereby the node N4X is charged and the potential of the node is changed toward VAH.

The turn-OFF voltage of the transistor NMOS1X is VAH−Vth because the input signal corresponds to the output of the first stage of voltage level converter circuit. Since the node N4X of the second stage circuit corresponds to the output terminal of the present embodiment, the node is connected to a load circuit. For this reason, the initial potential rise of the node is slower than the other nodes.

Accordingly, as shown in FIG. 8B, when a potential difference between the nodes N2X and N4X when the transistor NMOS1X is turned OFF at a time point t2*e* is denoted by ΔVCB2, respective time constants can be easily set so that ΔVCB2 is larger than ΔVCB1.

As a result, the voltage level converter can be applied to a signal having a higher frequency, by lowering the ON resistance of the MOS transistor NMOS3X in the output stage circuit and increasing the potential increasing rate at the output terminal N4X.

Further, the reset signal generating circuit RST in the embodiment 2 may employ any of the circuits shown in FIGS. 3, 5A, and 6A, like the embodiment 1.

Embodiment 3

Figure 9:
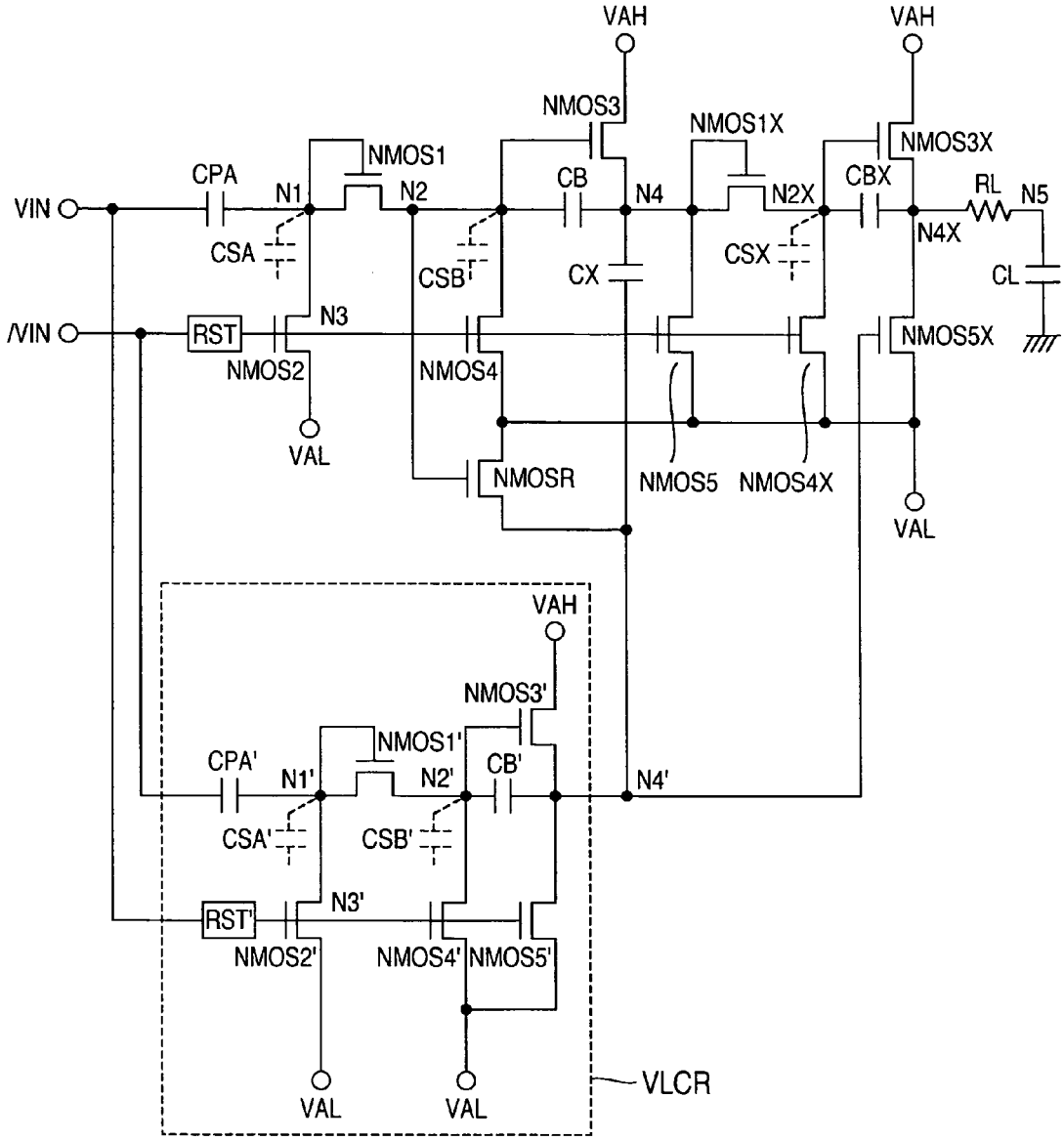
FIG. 9 is a further circuit arrangement of the voltage level converter VLC in the present invention.

An embodiment 3 of the voltage level converter VLC in the liquid crystal display device of FIG. 1 will be explained. FIG. 9 shows a circuit arrangement of a voltage level converter VLC in accordance with the present embodiment.

The voltage level converter VLC of FIG. 9 comprises a voltage level converter block (having substantially the same circuit arrangement as FIG. 7) of two stages to improve an increasing rate in the output potential of a voltage level converter circuit, and a converter block of a single stage (having substantially the same circuit arrangement as FIG. 2) for generating a high-amplitude gate voltage necessary for lowering the ON resistance of a MOS transistor of an output stage circuit of the voltage level converter block connected to the low voltage power supply line VAL to improve a decreasing rate (falling rate) in the output potential.

Explanation will next be made as to the wiring connection of each element. In the voltage level converter of FIG. 9, since the two-stage voltage level converter block has substantially the same arrangement as the voltage level converter of FIG. 7, elements having the same functions as those in FIG. 7 are denoted by the same reference symbols, and explanation thereof is omitted.

The one-stage converter block VELCRO has substantially the same arrangement as the voltage level converter VLC of FIG. 2. Thus elements having the same functions as those in the circuit diagram of FIG. 2 are denoted by the same reference symbols but with suffix "'" added.

As input signals for the one-stage converter block VLCR, the input signal /VIN is connected to a terminal of a capacitance CPA', and the input signal VIN is connected to a terminal of a reset signal generating circuit RST'.

A node N4' forming the output terminal of the one-stage converter block VLCR is connected to a gate terminal of the transistor NMOS5X in the output stage. One terminal of the capacitance CX is connected to the node N4' as the output terminal of the one-stage converter block VLCR, and the other terminal of the capacitance is connected to the node N4.

The voltage level converter of the present embodiment includes an n type MOS transistor NMOSR which has a first terminal connected to the node N4', a second terminal connected to the low voltage power supply line VAL, and a gate terminal connected to the node N2.

Figure 10:
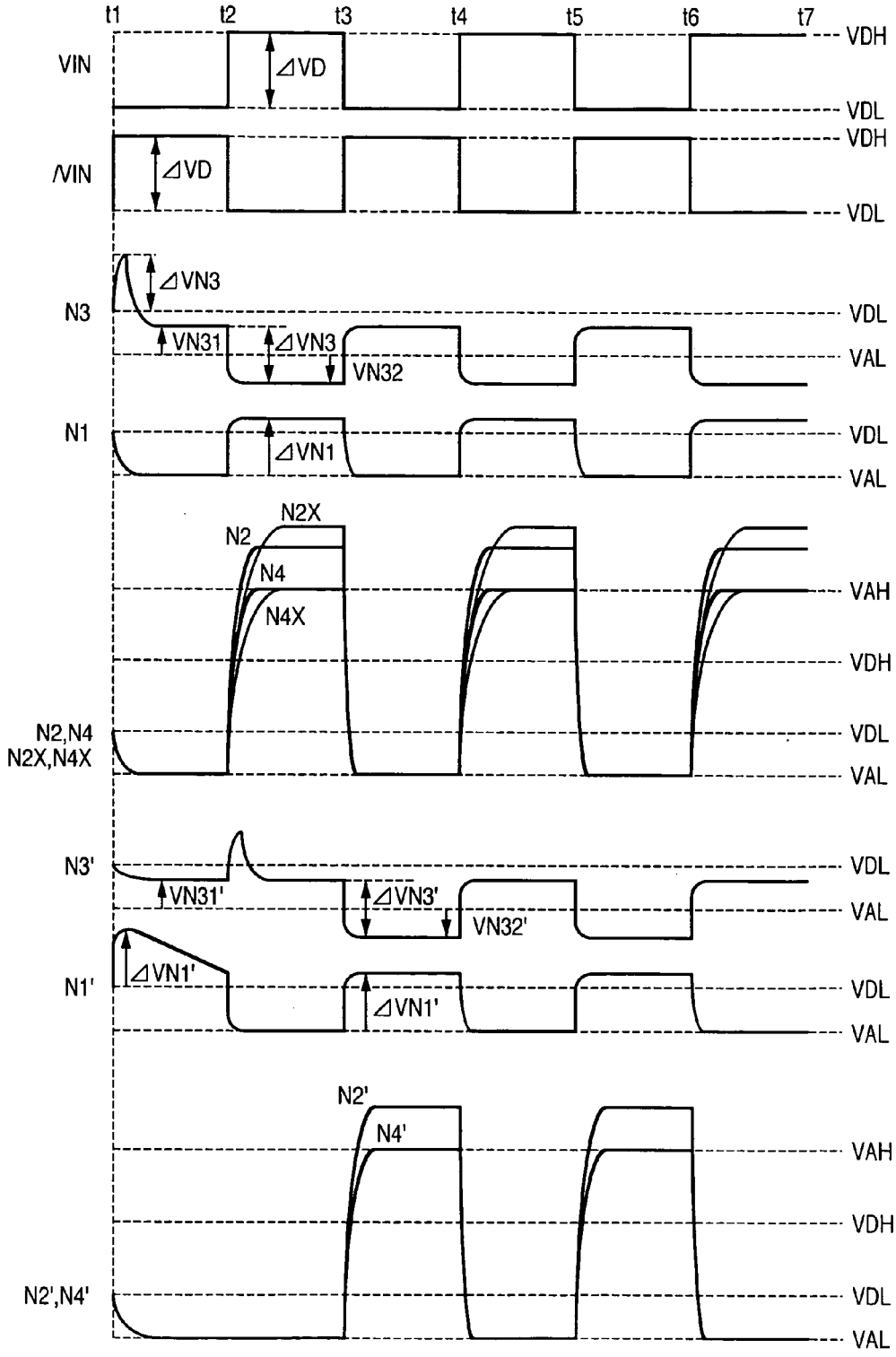
FIG. 10 is a timing chart showing the operation of the voltage level converter VLC of FIG. 9.

The operation of the voltage level converter having such an arrangement as explained above will be explained by using a timing chart of FIG. 10. In the voltage level converter of FIG. 9, the operation of the two-stage voltage level converter block is the same as explained in connection with FIG. 7.

When the input signal /VIN is changed from L level to H level at a time point t1, a potential at the node N3 is clipped by a potential at which the transistors NMOS2, NMOS4, NMOS5, and NMOS4X are turned ON. Thus, potentials at the nodes N1, N2, N4, and N2X vary toward VAL.

In the one-stage converter block VLCR, on the other hand, since the input signal /VIN is connected to the capacitance CPA', the potential of the node N1' varies toward its higher potential side by about ΔVN1'. However, since the input signal VIN connected to the input terminal of the reset signal generating circuit RST' in the one-stage converter block VLCR does not vary, this causes the potential of the node N1' not to be changed largely.

Assuming that a node N3' as the output terminal of the reset signal generating circuit RST' has an initial potential VDL and the equation (4) is satisfied, then the potential of the node N3' is clipped by a potential VN31' at which the transistors NMOS2', NMOS4', and NMOS5' are turned ON.

The potential of the node N1' subjected to the above potential change, and potentials at other nodes N2' and N4' also start to drop toward VAL.

When the potential of the node N4' varies from VDL to VAL, the transistor NMOS5X, which is put in the initial ON state, is turned OFF. Since the potential of the node N4X is discharged down to VAL during the ON state of the transistor NMOS5X, the voltage level converter has an output VAL as shown in FIG. 10.

When the input pulse VIN is changed from L level to H level at a time point t2, next, the potential at the node N3' as the output terminal of the reset signal generating circuit RST' is clipped in the one-stage converter block VLCR to a potential at which the transistors NMOS2', NMOS4', and NMOS5' is turned ON. Thus potentials at the nodes N1', N2', and N4' connected to the respective transistors NMOS are converged toward VAL.

As a result, the transistor NMOS5X having a gate voltage corresponding to the node N4', and VAL and the node N4X are electrically substantially cut off.

When the input signal /VIN is changed to H level to L level, the reset signal generating circuit RST causes the potential of the node N3 to be changed to its lower potential side, so that the transistors NMOS2, NMOS4, NNOS5, and NMOS4X are turned OFF.

As a result, the two-stage voltage level converter block performs substantially the same operation as the circuit of FIG. 7, thus increasing the potential of the node N4X as the output terminal up to VAH.

When the input signal VIN changes from H level to L level next at a time point t3, the input signal /VIN is changed from L level to H level, the reset signal generating circuit RST causes the potential of the node N3 to be clipped to a potential at which the transistors NMOS2, NMOS4, NMOS5, and NMOS4X are turned ON. Thus, the potentials of the nodes N1, N2, N4, and N2X in the two-stage voltage level converter block are transited to VAL.

The potential at the node N4' as the output terminal of the one-stage converter block VLCR is increased up to VAH, as explained in the embodiment 1. Since this causes VAH as the potential of the node N4' to be applied to the transistor NMOS5X, the ON resistance of the transistor NMOS5X can be reduced and the potential drop rate of the load circuit can be made faster. This enables even a higher-speed input signal to be subjected to the voltage level conversion.

At a time point t4, further, since the input signal /VIN is changed from H level to L level and input signal VIN is changed from L level to H level, the potential of the node N4X as the output terminal of the voltage level converter circuit in the present embodiment is increased to VAH and the potential of the node N4' as the output terminal of the one-stage converter block VLCR is decreased to VAL.

At this time, the capacitance CX plays a role of increasing a voltage applied to the transistor NMOS3, as explained in the embodiment 2.

In this example, as the potential of the node N4 increases, the capacitive coupling of the capacitance CX affects the potential drop of the node N4'. In the present embodiment, however, this presents no problem because the potential drop of the node N4' is assisted by the transistor NMOSR.

When the increasing rate of the potential of the node N4, the drop rate of the potential of the node N4', etc. present no problem, the capacitance CX or the transistor NMOSR can be omitted.

The reset signal generating circuit RST and the reset signal generating circuit RST' in the embodiment 3 may use any of the circuits of FIGS. 3, 5A, and 6A, similarly to the embodiment 1.

In the embodiments 1 to 3 explained above, explanation has been made in connection with the case where all the thin film transistors TFT used in the voltage level converter circuit are n type transistors. However, it goes without saying that the thin film transistors may be p type transistors. This is because inverse setting of high and low voltages enable the circuit to function as a voltage level converter VLC and have substantially the same effects.

In the foregoing embodiments, explanation has been made in connection with the case where the gate insulated films of the transistors used in each voltage level converter are made of $SiO_2$ as an example. However, such transistors may MIS transistors having the gate insulated films made of SiN as an example, as a matter of course.

Embodiment 4

Explanation will next be made as to an embodiment 4. The embodiment is directed to how to control the aforementioned voltage level converter. How to control the voltage level converter VLC in the foregoing embodiments 1 to 3 will be explained by referring to FIGS. 11 to 13.

Figure 11:
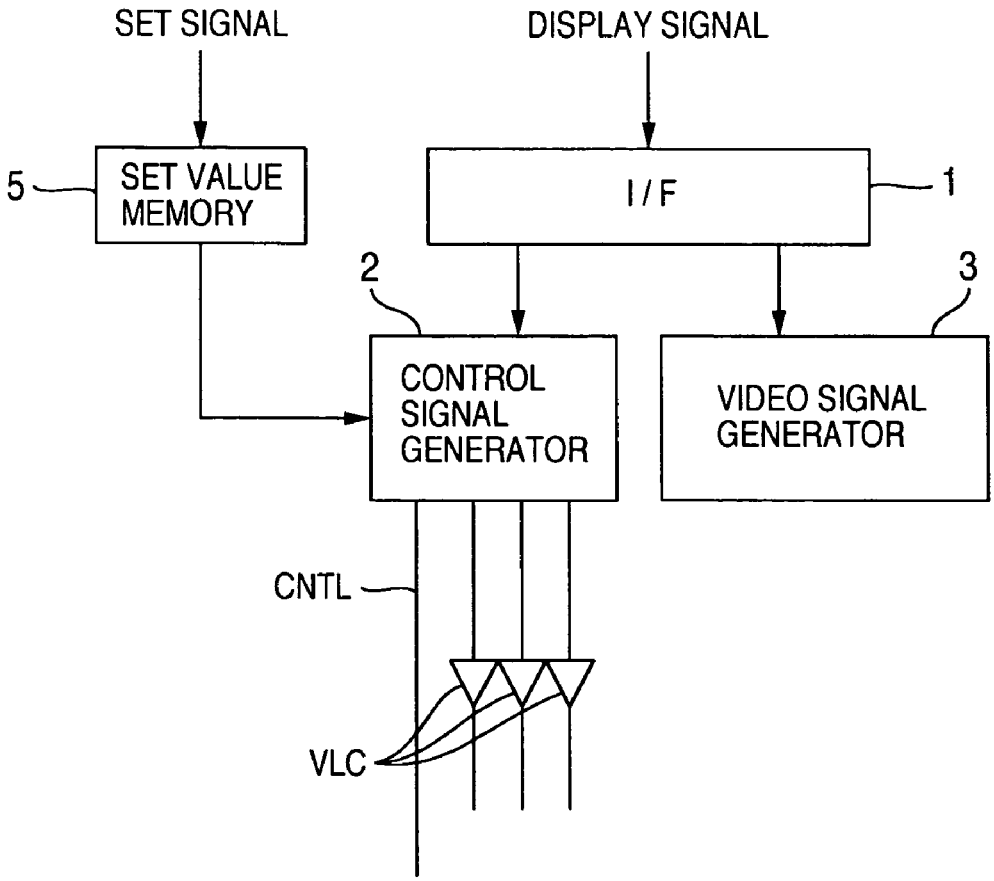
FIG. 11 schematically shows a part of the liquid crystal display device in the present invention.

FIG. 11 shows part of the liquid crystal display device in accordance with the present invention, wherein elements having the same functions as those in the embodiment 1 of FIG. 1 are denoted by the same reference numerals or symbols.

A set value memory 5 in the liquid crystal display device shown in FIG. 11 stores a set signal externally entered (input from an external system for controlling the display device).

The set signal includes a signal for setting a stabilization period necessary until the initial operation of the voltage level converter VLC is stabilized. A control signal generator 2 receives a set value relating to the stabilization period from the set value memory 5, and on the basis of the received set value, outputs the input pulse VIN and its inverted input pulse /VIN to the voltage level converter VLC.

Figure 12A:
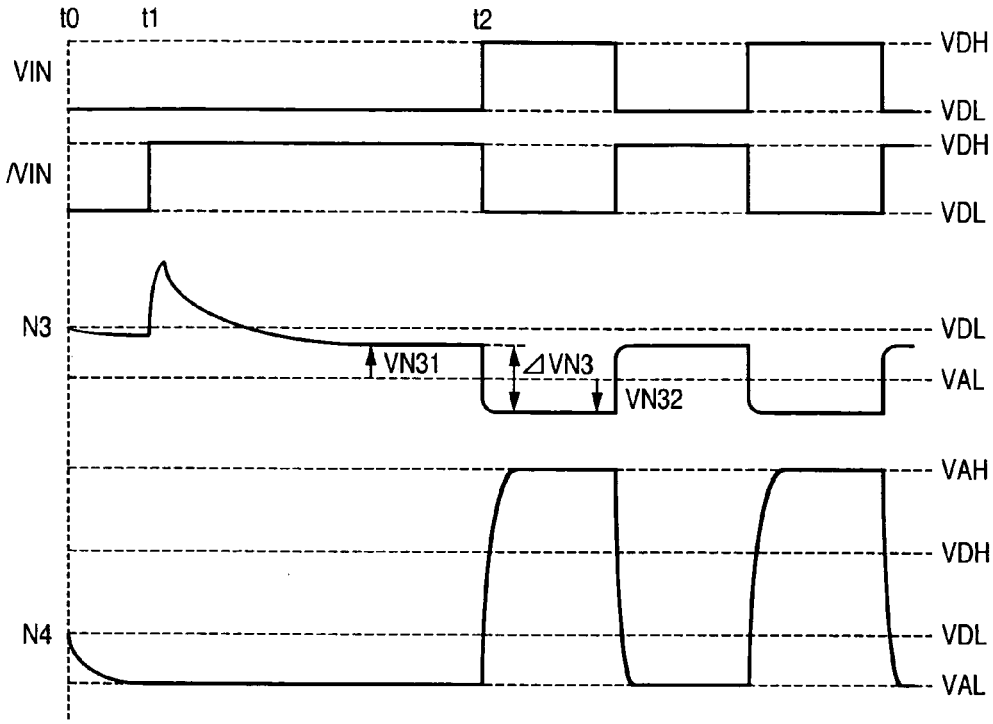
FIGS. 12A and 12B show timing charts showing the operations of the voltage level converter VLC of FIG. 11 respectively.
Figure 12B:
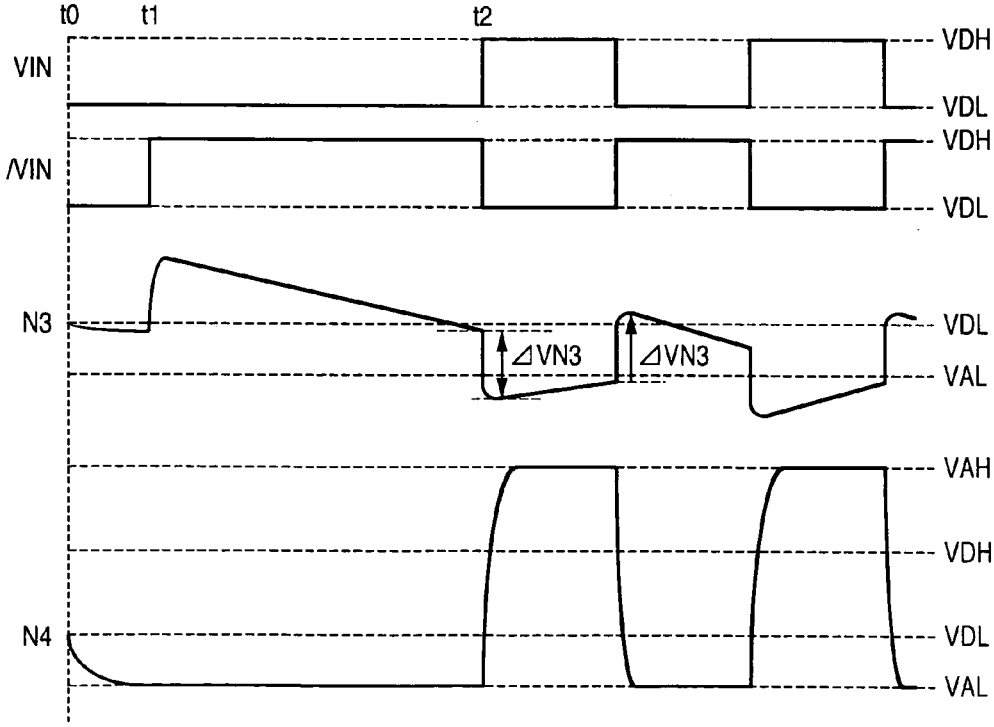

FIGS. 12A and 12B show timing charts showing relations among the input signals (VIN and /VIN) to the voltage level converter VLC from the control signal generator 2 in FIG. 11, the then output signal (potential at the node N3) from the reset signal generating circuit RST, and the then output signal (potential at the node N4) of the voltage level converter VLC.

FIG. 12A is the timing chart explaining the stabilization of the initial operation of the voltage level converter VLC when the reset signal generating circuit RST shown in FIG. 3 is used in the voltage level converter VLC (FIGS. 2 and 7) explained in the embodiments 1 and 2.

It is assumed in FIG. 12A that the input pulses VIN and /VIN are set at a reset level potential (VDL as an example in this example) at a start time point to. This is for the purpose of putting the nMOS transistor connected to the node N3 in the OFF state when the operation of the voltage level converter VLC is started.

Thereafter, at a time point t1, the input signal /VIN is changed from VDL to VDH to cause the input signals VIN and /VIN to have an inversed phase relation. At this time, a potential at the node N3 as the output of the reset signal generating circuit RST is once increased by capacitive coupling. However, the potential is transited toward VAL through the diode-connected nMOS transistor and clipped by the potential VN31.

Since the nMOS transistor controlled by the potential of the node N3 during the clipping is turned ON, the output voltage of the voltage level converter VLC is set at VAL.

At a next time point t2, the operation of the voltage level converter VLC is started and the input pulse /VIN is set at VDL. As a result, the potential of the node N3 as the output voltage of the reset signal generating circuit RST is changed to VN32, and the nMOS transistor connected to the node N3 is turned OFF. Thus the change of the input pulse VIN to VDH enables the output of the voltage level converter VLC to be level converted to VAH.

In order to stabilize the initial operation of the voltage level converter VLC, in this way, by substantially converging the output of the reset signal generating circuit RST to VN31 until the time point t2 or by changing at least the input pulse /VIN from VDH to VDL, it is necessary to cause the potential of the node N3 to arrive at a level at which the nMOS transistor connected to the node N3 as the output of the reset signal generating circuit RST is shifted to the ON state to the OFF state.

To this end, in the present embodiment, a period t2 necessary to realize the stable initial operation is previously stored in the control signal generator 2 and the control signal is output from the control signal generator on the basis of the stored data, thus realizing the stable operation without any erroneous operation.

Although explanation has been made in connection with the case where the reset signal generating circuit RST of FIG. 3 is used in the present embodiment, substantially the same control can be obtained even by using the circuit of FIG. 5A, realizing the stable circuit operation without any erroneous operation.

FIG. 12B shows the timing chart when the reset signal generating circuit RST of FIG. 6A is used in the voltage level converters VLC (FIGS. 2 and 7) explained in the embodiments 1 and 2.

In this case, it is required at the time point t2 that the potential of the node N3 as the output of the reset signal generating circuit RST arrive at a level at which the nMOS transistor connected to the node N3 as the output of the reset signal generating circuit RST is changed from the ON state to the OFF state, by changing at least the input pulse /VIN from VDH to VDL.

With such an arrangement, even when the reset signal generating circuit RST of FIG. 6A is used, the stable initial operation can be realized.

Figure 13:
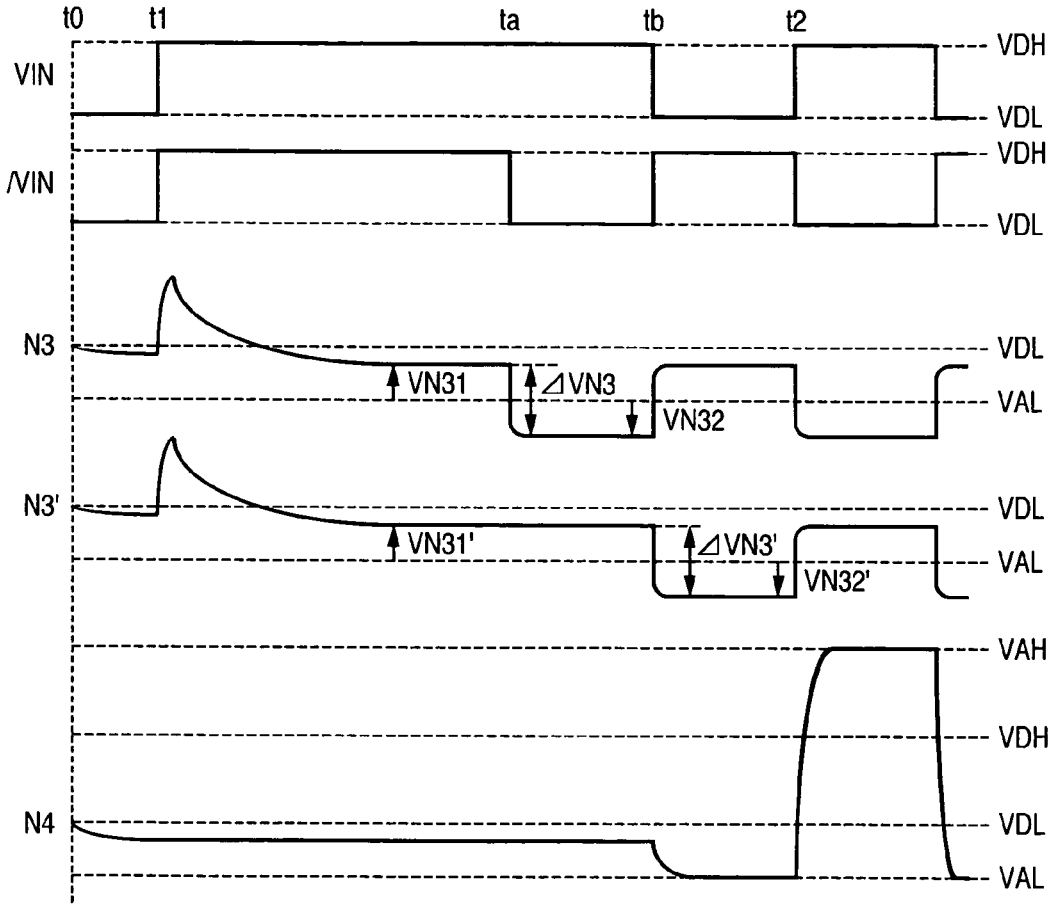
FIG. 13 is a timing chart showing the operation of the voltage level converter VLC of FIG. 11.

FIG. 13 is a timing chart explaining the stabilization of initial operation of the voltage level converter VLC when the reset signal generating circuit RST of FIG. 3 is used in the voltage level converter VLC (FIG. 9) explained in the embodiment 3.

In FIG. 13, it is assumed that the input pulses VIN and /VIN are set at a reset level potential (VDL as an example in this embodiment) at a start time point t0.

At a time point t1 after t0, the input pulse /VIN is changed from VDL to VDH and the input pulse VIN is changed from VDL to VDH. This is for the purpose of causing the nMOS transistors connected to the nodes N3 and N3' as the outputs of the reset signal generating circuits RST and RST' to be turned OFF when the input pulses VIN and /VIN is changed to VDL. When the input pulses VIN and /VIN are changed to VDH, the potentials at the nodes N3 and N3' are once increased by capacitive coupling, transited toward VAL through the diode-connected nMOS transistor in the reset signal generating circuit RST, and then clipped by the potentials VN31 and VN31'.

In order to cause the input pulse signals VIN and /VIN to have an inverted phase relation at a time point ta, next, the input signal /VIN is changed to VDL. In this case, the voltage level converter VLC is put in the reset state at VAL. When it is desired to put the voltage level converter VLC in the reset state at VAH to the contrary, the input signal VIN is changed to VDL at the timing of a time point ta.

When the input signal VIN is changed to VDL and the input signal /VIN is changed to VDH at a next time point tb, the output signal of the voltage level converter VLC can be reset at VAL, and the stable operation of the voltage level converter VLC can be started from the time point t2. Substantially the same control can be realized even when the reset signal generating circuits RST of FIGS. 5A and 6A are used.

The present invention has been explained mainly connection with the liquid crystal display device. However, the present invention can be applied not only the above liquid crystal display device but also to general display devices such as an organic EL display device or an electron emission type display device wherein elements including a thin film transistor or a diode in a peripheral circuit made of polysilicon having a charge mobility higher than amorphous silicon or made of silicon close to single crystalline silicon.

Embodiment 5

Explanation will be made as to an embodiment 5 of the present invention to realize the voltage level converter VLC in the liquid crystal display device of FIG. 1.

Figure 14:
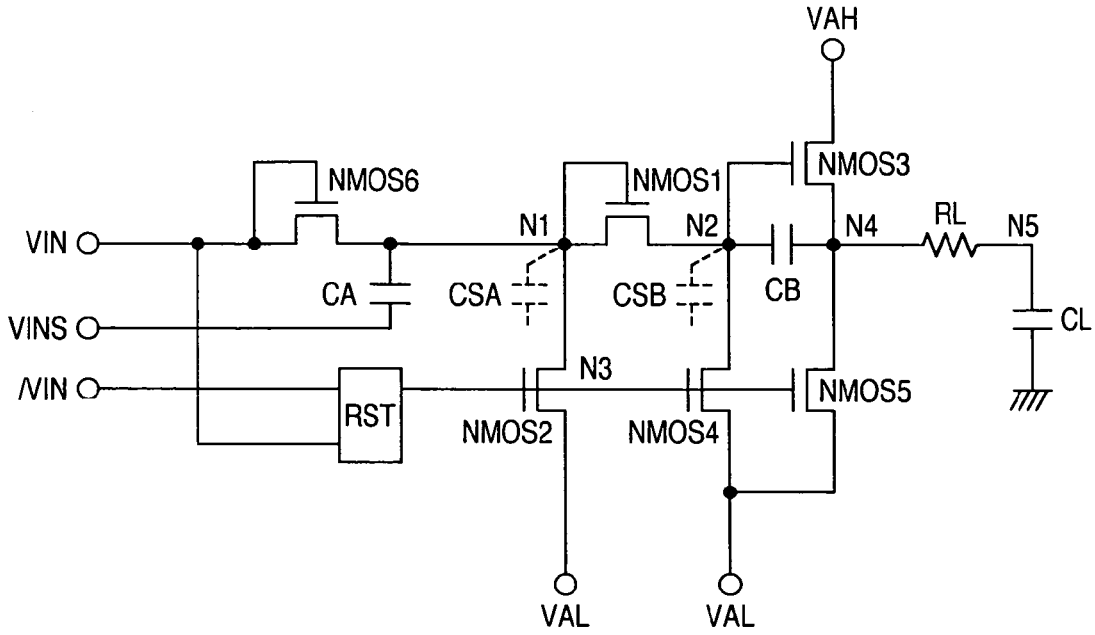
FIG. 14 is yet another circuit arrangement of the voltage level converter VLC in the present invention.

FIG. 14 is a circuit diagram for explaining a circuit arrangement of the voltage level converter VLC of the present embodiment. In the circuit arrangement of FIG. 14, an input terminal for the input pulse VIN is connected to gate and first terminals (the first terminal referring to one of its source and drain terminals) of an n type MOS transistor NMOS6 as a MIS TFT. An input terminal for an input pulse VINS is connected to one terminal of a capacitance CA. The other terminal of the capacitance CA is connected to a second terminal (referring to the other of the source and drain terminals) of the transistor NMOS6, to gate and first terminals of an n type MOS transistor NMOS1 as a MIS TFT, and also to a first terminal of an n type MOS transistor NMOS3 as a MIS TFT, which interconnection forms a node N1.

A second terminal of the transistor NMOS1 is connected to one terminal of a capacitance CB, to a gate terminal of an n type MOS transistor NMOS3 as a MIS TFT, and also to a first terminal of an n type MOS transistor NMOS4 as a MIS TFT, which interconnection forms a node N2. The other terminal of the capacitance CB is connected to a first terminal of the transistor NMOS3 and to a first terminal of an n type MOS transistor NMOS5 as a MIS TFT, which interconnection forms a node N4.

Two input terminals of the reset signal generating circuit RST are connected to an input terminal for an input pulse /VIN having a phase corresponding to an inversion of the input pulse VIN and also to an input terminal for the input pulse VIN. An output terminal of the reset signal generating circuit RST is connected to the gate terminal of the transistor NMOS2 and also to gate terminals of the transistors NMOS4 and NMOS5, which interconnection forms a node N3.

A second terminal of the transistor NMOS3 is connected to a high voltage power supply line VAH. A second terminal of the transistor NMOS2, a second terminal of the transistor NMOS4, and a second terminal of the transistor NMOS5 are connected to a low voltage power supply line VAL.

In the voltage level converter shown in FIG. 14, the node N4 forms an output terminal which is connected, in this example, to resistive and capacitive loads of a load resistance RL and a load capacitance CL connected in series between the output terminal (N4) and the ground. An interconnection between the load resistance RL and the load capacitance CL forms a node N5.

Though not shown in the drawing, the voltage level converter VLC of FIG. 14 includes a charge circuit (of the transistors NMOS1, NMOS3, NMOS6, and the capacitances CA and CB), a discharge circuit (of the transistors NMOS2, NMOS4, and NMOS5), and the reset signal generating circuit RST.

A capacitance CSA shown by a dashed line in the drawing denotes a parasitic capacitance, and a capacitance CSB shown by a dashed line denotes a parasitic capacitance including the wiring capacitance of the node N2 present except for the capacitance CB.

Figure 15:
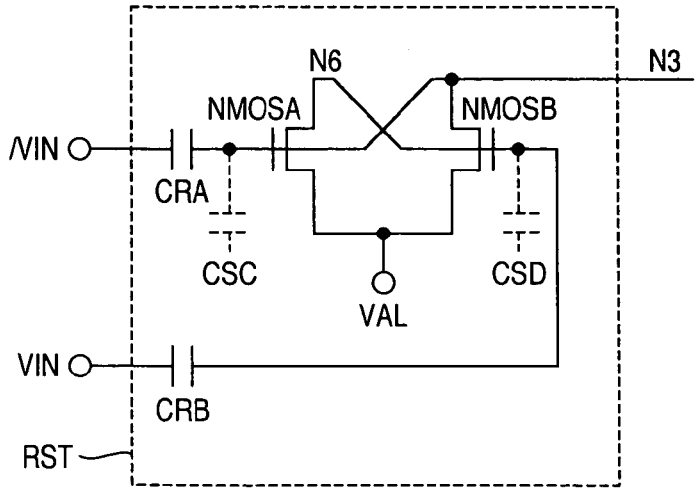
FIG. 15 is yet another circuit arrangement of the reset signal generating circuit RST in the present invention.

FIG. 15 is an embodiment of the reset signal generating circuit RST shown in FIG. 14, wherein an input terminal for an input signal /VIN is connected to one terminal of a capacitance CRA, and an input terminal for an input signal VIN is connected to one terminal of a capacitance CRB. The other terminal of the capacitance CRA is connected to a gate terminal of an n type MOS transistor NMOSA as a MIS TFT and to a first terminal of an n type MOS transistor NMOSB as a MIS TFT, which interconnection forms the output terminal of the reset signal generating circuit RST, that is, forms a node N3 of the voltage level converter VLC. The other terminal of the capacitance CRB is connected to a gate terminal of the transistor NMOSB and to a first terminal of the transistor NMOSA, thus forming a node N6. A second terminal of the transistor NMOSA and a second terminal of the transistor NMOSB are connected to a low voltage power supply line VAL. A capacitance CSC shown by a dashed line is a parasitic capacitance including the wiring capacitance of the node N3 present except for the capacitance CRA, and a capacitance CSD shown by a dashed line is a parasitic capacitance including the wiring capacitance of the node N6 present except for the capacitance CRB.

Figure 16:
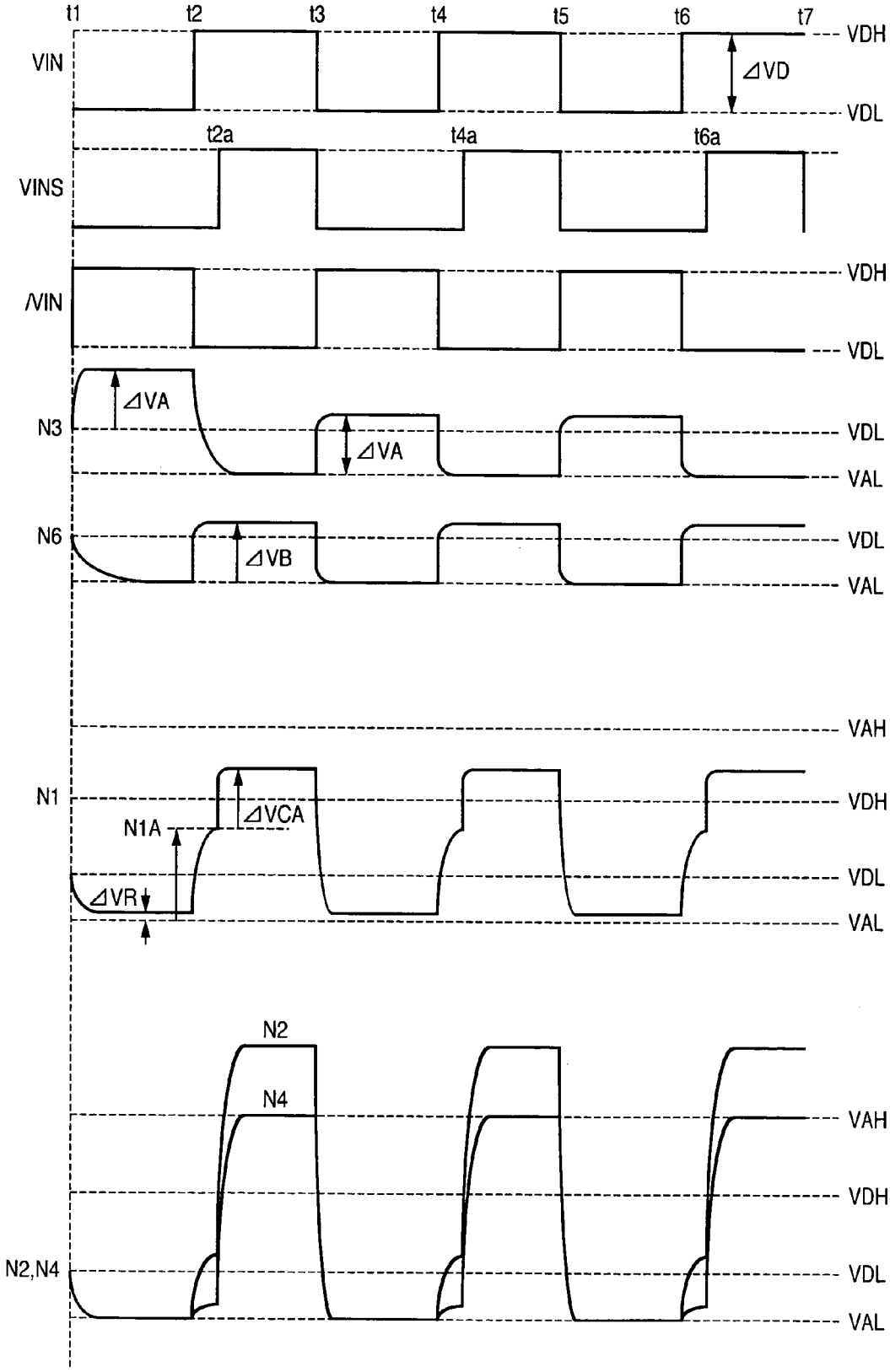
FIG. 16 is a timing chart showing the operation of the voltage level converter VLC of FIG. 14.

Explanation will next be made as to the operation of the voltage level converter VLC mentioned above by using FIG. 16. FIG. 16 shows waveforms of the input signals VIN, VINS, and /VIN and waveforms of signals appearing at nodes (N1, N2, N3, N4, and N6) in FIG. 14. It is assumed in the following explanation that the equations (1) to (4) explained in the embodiment 1 of the present invention are satisfied. It is also assumed that the maximum and minimum potentials of the input signal VINS are equal to those of the other input signals VIN and /VIN. Further, n type MOS transistors as MIS TFTs are assumed to have the same threshold voltage Vth.

It is assumed in FIG. 16 that the input signals and potentials at the respective nodes are set at VDL in the initial state. Explanation will be first made as to the operation when the input signal /VIN is changed from L level to H level at a time point t1. The input signal /VIN is capacitively coupled to the node N3 through the capacitance CRA in the reset signal generating circuit RST. For this reason, a voltage change ΔVD in the input signal /VIN causes the potential of the node N3 to be changed. Assuming that the change at this time is denoted by ΔVA, then the change is generally expressed by an equation (23) which follows.

$$\Delta VA=\Delta VD\times CRA/(CRA+CSC) \quad (23)$$

At this time, since the potential of the node N3 is VDL or higher, a voltage of the threshold voltage Vth or higher is applied to the gate terminal of the transistor NMOSA from the relation of the equation (4). As a result, the transistor NMOSA is turned ON so that the node N6 is discharged to VAL. When the node N6 is discharged and changed to have a potential of VAL, the transistor NMOSB is turned OFF so that the potential of the node N3 is kept. Accordingly, the output voltage (at the node N3) of the reset signal generating circuit RST becomes VDL or higher during a period between the time points t1 and t2. This results in that the transistors NMOS2, NMOS4, and NMOS5 forming the discharge circuit are turned ON and the nodes N1, N2, and N4 are discharged to.VAL. At this time, a current flows between the input signal VIN and VAL through the transistors NMOS6 and NMOS2. When a potential difference between VDL and VAL is small, however, a current value becomes also small and thus this less affects a power consumption. When a voltage drop ΔVR is caused by the transistor NMOS2, the node N1 is converged to a potential higher by the voltage drop ΔVR than VAL. At this time, since the transistor NMOS2 is put in the ON state, the ON resistance of the transistor NMOS2 is small and thus the voltage drop ΔVR is also small.

Explanation will next be made as to the operation when the input signal VIN is changed from L level to H level and the input signal /VIN is changed from H level to L level at the time point t2.

The input signal VIN is capacitively coupled with the node N6 by the capacitance CRB in the reset signal generating circuit RST. For this reason, the ΔVD in the input signal VIN causes the potential of the node N6 to be changed. The change ΔVB at this time is generally expressed by an equation (24) which follows.

$$\Delta VB=\Delta VD\times CRB/(CRB+CSD) \quad (24)$$

Accordingly, the potential of the node N6 is higher by the change ΔVB than VAL. At this time, when the change ΔVB is larger than the threshold voltage Vth of the transistor NMOS, the transistor NMOSB is turned ON. For this reason, it is in this example required to set the capacitances CRB and CRA so that the changes ΔVB and ΔVA are larger than the threshold voltage of the n type MOS transistor. The potential of the node N3 is changed to its lower potential side by ΔVA by the change of the input signal /VIN at the time point t2, and the node N3 is discharged to VAL through the turned-ON transistor NMOSB. When the node N3 is discharged to VAL, the transistor NMOSA is turned OFF. Thus the potential of the node N6 can keep the transistor NMOSB in the ON state. Since the output signal (at the node N3) of the reset signal generating circuit RST is at VAL at the time point t2 and subsequent time points from the above explanation, the discharge circuit is turned OFF and the operation of the charge circuit is enabled.

When the input signal VIN is changed to H level at the time point t2, first of all, the capacitance CA is charged toward VDH through the diode-connected transistor NMOS6. As a result, the potential of the node N1 reaches NIA before a time point t2*a*. Since the potential NIA is clipped by the transistor NMOS6 at this time, the potential NIA has a level of (VDH−Vth) at the highest.

Explanation will next be made as to the operation when the input pulse VINS is changed from L level to H level at the time point t2*a*. The input pulse VINS is capacitively connected to the node N1 by the capacitance CA. For this reason, the voltage change ΔVD in the input pulse VINS causes the potential of the node N1 to increase. A potential change ΔVCA at this time is generally expressed by an equation (25) which follows.

$$\Delta VCA=\Delta VD\times CA/(CA+CSA) \quad (25)$$

Accordingly the node N1 has a potential of (N1A+ΔVCA). At this time, when a time interval between the time points t2 and t2*a* and the design values of the capacitance CA and transistor NMOS6 are set so that the potential (N1A+ΔVCA) is higher than VDH, a potential difference between the nodes N2 and N4 can be made larger than that in the embodiment 1. Since the structure of the charge circuit subsequent to the node N1 is the same as those in the embodiment 1, the explanation of the structure subsequent to the node N1 and subsequent nodes is omitted. But the larger potential difference between the nodes N2 and N4 during the operation of the charge circuit causes the ON resistance of the transistor NMOS3 to be made smaller, with the result that the voltage level converter VLC can be operated at a high speed.

In the present embodiment, the reset signal generating circuit RST using two signals of the input signals VIN and /VIN as shown in FIG. 15 has been used. However, even when such reset signal generating circuit RST for generating an output signal from the input signal /VIN as shown in FIGS. 3, 5, and 6 in the embodiment 1 is used, substantially the same effects can be obtained.

Figure 17:
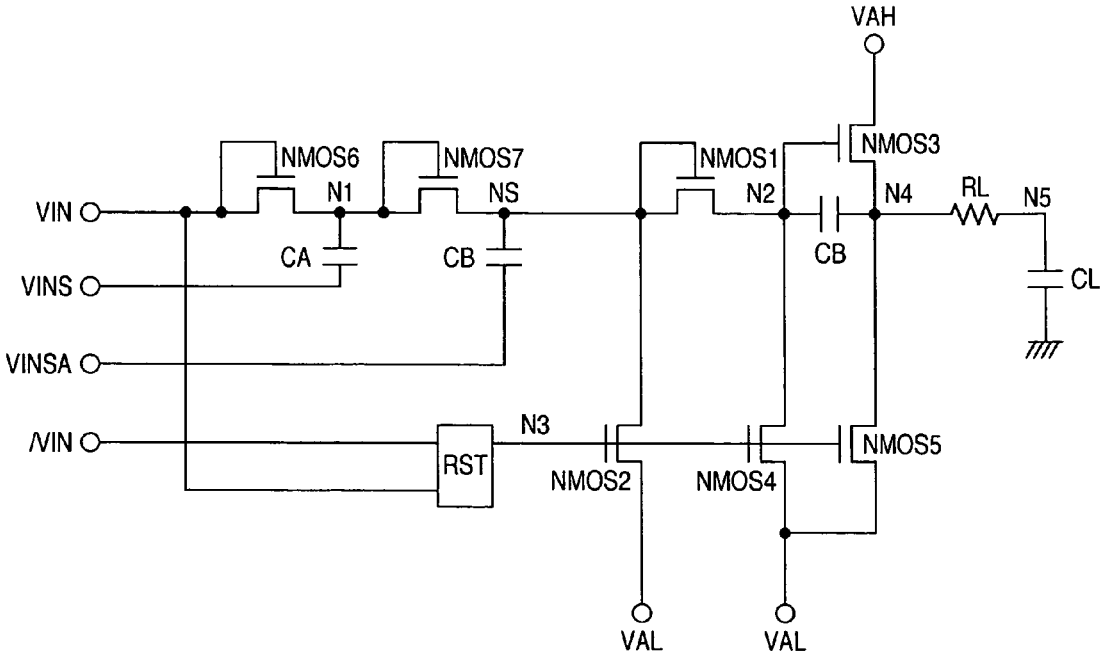
FIG. 17 is a still further circuit arrangement of the voltage level converter VLC in the present invention.

FIG. 17 is a circuit diagram for explaining another circuit arrangement of the voltage level converter VLC in the embodiment 5. The voltage level converter VLC of FIG. 17 corresponds to the voltage level converter VLC of FIG. 14, but is different therefrom in that an n type MOS transistor NMOS7 as a MIS TFT as well as an input signal VINSA are added. In the circuit arrangement shown in FIG. 17, an input terminal for an input signal VIN is connected to gate and first terminal of the transistor NMOS6. An input terminal for an input pulse VINS is connected to one terminal of a capacitance CA. The other terminal of the capacitance CA is connected to a second transistor NMOS6 and to gate and first terminals of a transistor NMOS7, which interconnection forms a node N1. The input terminal of the input signal VINSA is connected to one terminal of a capacitance CB. The other terminal of the capacitance CB is connected to a second terminal of the transistor NMOS7, to gate and first terminals of the transistor NMOS1, and to a first terminal of the transistor NMOS2, thus forming a node NS. Since the transistors NMOS1 to NMOS5, the capacitance CB, resistive and capacitive loads as the other constituent elements, and the reset signal generating circuit RST have substantially the same structures as those in FIG. 14; explanation thereof is omitted. Although the reset signal generating circuit RST the reset signal generating circuit RST in the voltage level converter VLC of FIG. 17 is the same as the circuit of FIG. 15, the present invention is not limited to the above example, as explained above.

Figure 18:
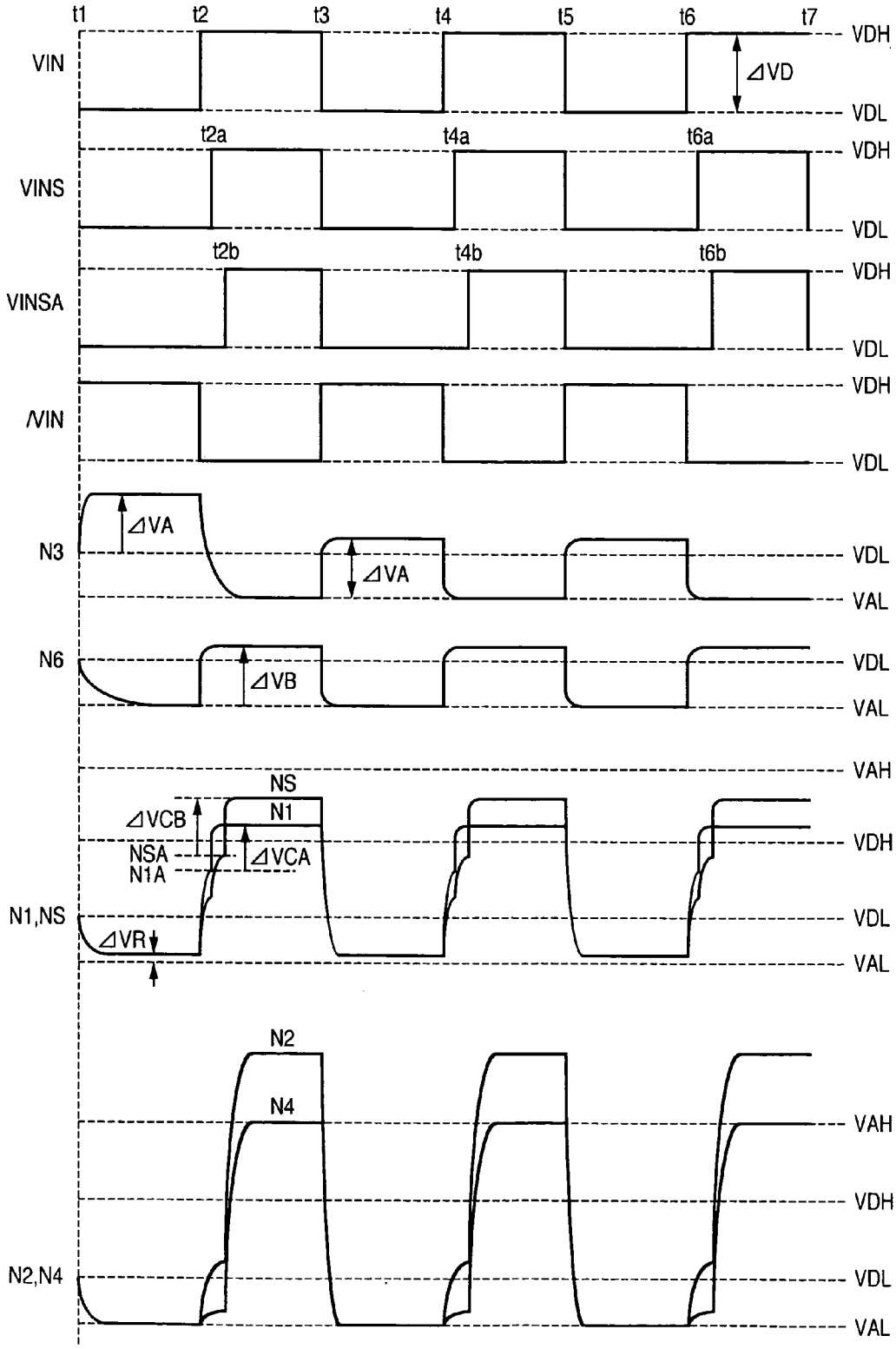
FIG. 18 is a timing chart showing the operation of the voltage level converter VLC of FIG. 17.

Explanation will then be made by referring to FIG. 18 as to the operation of the voltage level converter VLC of FIG. 17. FIG. 18 shows waveforms of input signals VIN, VINS, VINSA, and /VIN and the waveforms of signals appearing at nodes (N1, N2, N3, N4, N6, and NS) in FIG. 17. It is assume in the following explanation that the relations of the equation (1) to (4) are satisfied as mentioned in connection with the embodiment 1 of the invention. It is also assumed that the maximum and minimum potentials of the input signal VINSA are equal to the other input signal VIN or the like. Further, n type MOS transistors as MIST TFTs are assumed to have the same threshold voltage Vth.

On the assumption in FIG. 18 that the input signal and the potentials of the nodes are VDL in the initial state; the operation when the input signal /VIN is changed from L level to H level at a time point t1 will be first explained. When the input signal /VIN is changed from L level to H level, the potential of the node N3 is increased and the transistor NMOSA is turned ON as mentioned above, whereby the node N6 is discharged to VAL. When the node N6 is discharged and arrives at the potential VAL, the transistor NMOSB is turned OFF. As a result, the potential of the node N3 is kept at VDL or higher, the transistors NMOS2, NMOS4, and NMOS5 forming the discharge circuit are put in the ON state during a period between the time points t1 and t2, and the nodes NS, N2, and N4 are discharged to VAL. At this time, a current flows between the input signal VIN and VAL through the transistors NMOS6, NMOS7, and NMOS2. However, when a potential difference between VDL and VAL is small, its current value is also small. Thus this less affects a power consumption. When compared with the voltage level converter of FIG. 14 mentioned above, one stage of a diode-connected NMOS transistor is increased between the input signal VIN and VAL, a current flowing through the stage path can be made smaller.

Explanation will next be made as to the operation when the input signal VIN is changed from L level to H level and the input signal /VIN is changed from H level to L level at the time point t2. Since the change of the input signal VIN from L level to H level causes the potential of the node N6 to be higher by ΔVB higher than VAL, the transistor NMOSB is turned ON. As a result, the node N3 is discharged to VAL through the transistor NMOSB, the transistor NMOSA is turned OFF, and the potential of the node N6 can keep the transistor NMOSB in the ON state. Even in this case, the capacitances CRB and CRA are required to be set so that ΔVB and ΔVA are larger than the threshold voltage of the n type MOS transistor. From the above explanation, at the time point t2 and subsequent time points, the discharge circuit is put in the OFF state and the operation of the charge circuit can be realized.

In the operation of the charge circuit, when the input signal VIN is changed to H level at the time point t2, the capacitance CA is charged to VDH through the diode-connected transistor NMOS6, with the result that the potential of the node N1 reaches NIA before the time point t2*a*. At this time, since the potential NIA is clipped by the transistor NMOS6, the potential NIA becomes (VDH−Vth) at highest.

Explanation will next be made as to the operation when the input signal VINS is changed from L level to H level at the time point t2*a*. The input signal VINS is capacitively coupled with the node N1 by the capacitance CA. Thus a voltage change ΔVD in the input pulse VINS causes the potential of the node N1 to be increased. The change ΔVCA at this time is generally determined by the capacitance CA and by the parasitic capacitance of the node N1 present other than the capacitance CA. Thus after the time point t2*a*, the potential of the node N1 becomes (N1A+ΔVCA). It is assumed that the node NS is charged to the potential (N1A+ΔVCA) corresponding to the potential of the node N1 through the diode-connected transistor NMOS7, and arrives at a potential NSA. In this case, the potential NSA, which is clipped by the transistor NMOS7, becomes (N1A+ΔVCA−Vth) at highest.

Explanation will then be made as to the operation when the input signal VINSA is changed from L level to H level at a time point t2*b*. The input signal VINSA is capacitively coupled with the node NS by the capacitance CB. For this reason, a voltage change ΔVD in the input signal VINSA causes the potential of the node NS to be increased. The then change ΔVCB is generally determined by the capacitance CB and by the parasitic capacitance of the node NS present other than the capacitance CB. Thus, after the time point t2*b*, the potential of the node NS becomes (NSA+ΔVCB).

At this time, when intervals between the time points t2, t2*a*, and t2*b*, the capacitances CA and CB, and the design values of the transistors NMOS6 and NMOS7 are set so that the potential (NSA+ΔVCB) is higher than VDH, and a potential difference between the nodes N2 and N4 can be made larger than that in the embodiment 1. Since the arrangement of the charge circuit after the node NS and subsequent nodes is the same as in the embodiment 1, explanation of the operation thereof is omitted. However, the larger potential difference between the nodes N2 and N4 during the operation of the charge circuit can advantageously make the ON resistance of the transistor NMOS3 smaller and thus the voltage level converter can be operated at a high speed.

Embodiment 6

An embodiment 6 is directed to a circuit scheme for suppressing a current flowing through the diode-connected NMOS transistor and the transistor NMOS2 between the input terminals VIN and VAL when the discharge circuit is put in the ON state in the voltage level converter VLC of the embodiment 5 shown in FIGS. 14 and 17.

Figure 19:
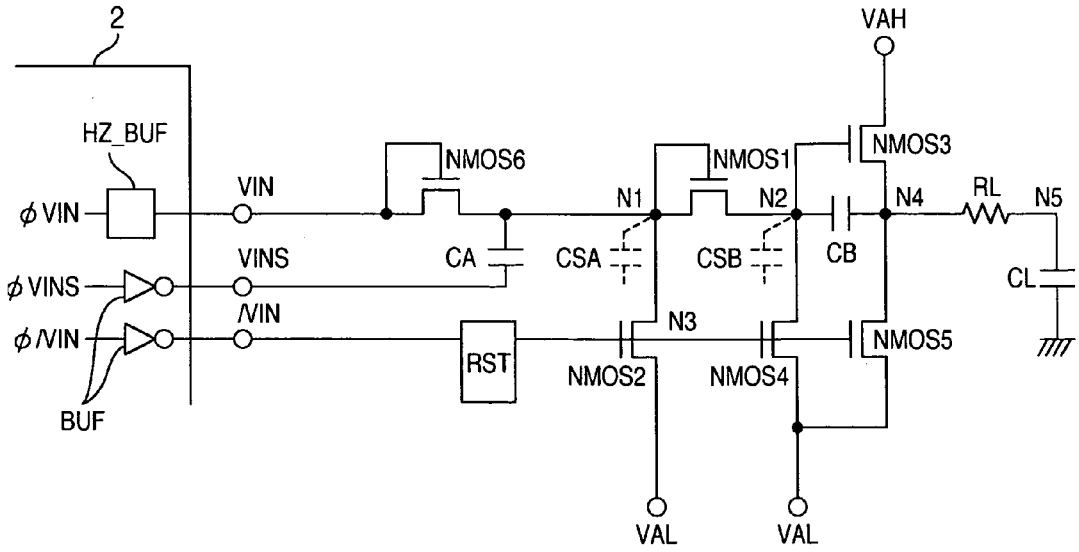
FIG. 19 schematically shows the voltage level converter of the invention and its peripheral circuit.

FIG. 19 shows a circuit diagram of a voltage level converter VLC and a control signal generator 2 in the embodiment 6. In FIG. 19, the illustrated voltage level converter VLC has the same structure as that in FIG. 14 explained in the embodiment 5. However, it is assumed that the reset signal generating circuit RST has the same circuit arrangement as the circuits of FIGS. 3, 5, and 6 operable only by the input signal /VIN. The control signal generator 2 generates input signals VIN, VINS, and /VIN necessary for controlling the voltage level converter VLC. In this case, the input signals VINS and /VIN have a maximum potential VDH and a minimum potential VDL, as already explained in the embodiments 1 to 5. It is assumed in this example that, in the control signal generator 2, the input signals VINS and /VIN are output from buffers BUF in order to increase the driving capability of the input signals VINS and /VIN. FIG. 19 shows a CMOS inverter as an example. An antiphase signal ϕVINS corresponding to an inversion of the input signal VINS and an antiphase signal ϕ/VIN corresponding to an inversion of the input signal /VIN are input to the inverter.

Figure 20:
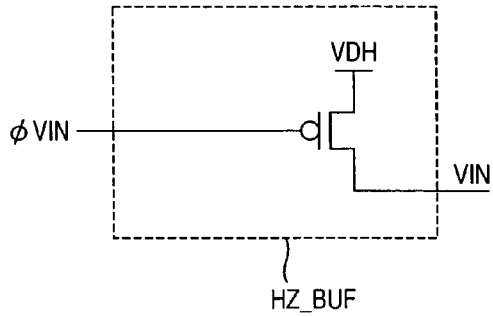
FIG. 20 is a circuit arrangement of a buffer HZ_BUF in FIG. 19.

Meanwhile, the input signal VIN is put in its HiZ state at the timing when the minimum potential VDL is output in the explanation of the embodiments 1 to 5, that is, the terminal of the input signal VIN electrically cut off from a power source VDH. And only at the timing when the maximum potential VDH is output, the terminal of the input signal VIN is electrically connected to the power source VDH and the potential VDH is output. FIG. 20 shows an exemplary circuit of such a buffer HZ_BUF that outputs the maximum potential VDH only during the Hi level period and is put in the HiZ state during the Low level period. A signal ϕVIN has a low level (e.g., VDL) during the high level period of the input signal VIN and has a high level (e.g., VDH) during the low level period thereof. The buffer HZ_BUF is made of a PMOS transistor which has a gate terminal connected to signal ϕVIN, a first terminal connected to the power source VDH, and a second terminal connected to the input signal VIN of the voltage level converter as an output terminal. As a result, since the PMOS transistor is turned OFF when the signal ϕVIN is at the high level, the input signal VIN is put in the HiZ state. Since the PMOS transistor is turned ON when the signal ϕVIN is at the low level, the input signal VIN has an output potential VDH.

Figure 21:
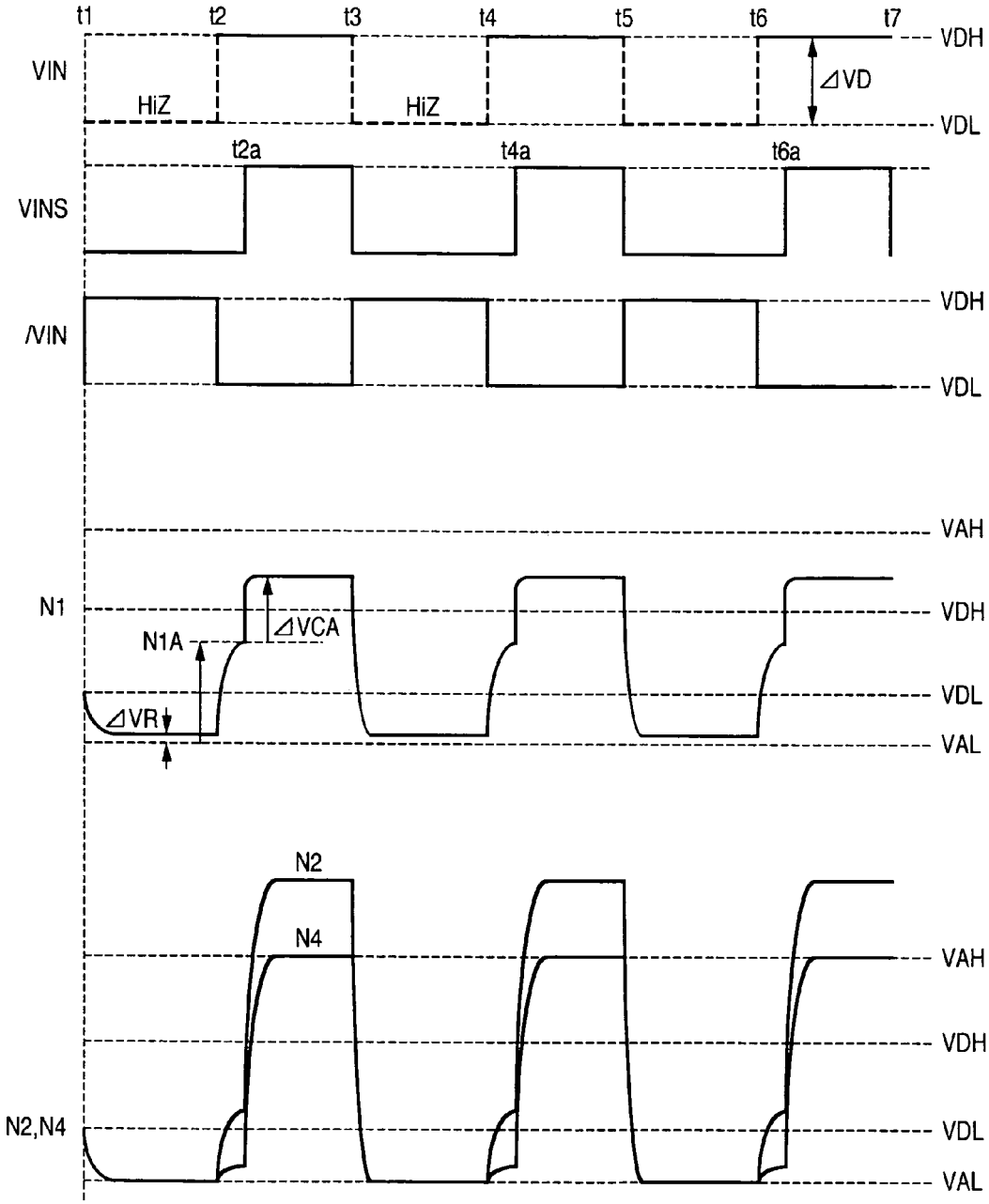
FIG. 21 is a timing chart showing the operation of the voltage level converter VLC of FIG. 19.

Explanation will then be made as to the circuit arrangement of FIG. 19 by referring to FIG. 21. FIG. 21 shows waveforms of the input signals VIN, VINS, and /VIN and waveforms of voltages appearing at the nodes N1, N2, and N4 shown in FIG. 19.

Explanation will first be made as to the operation when the input signal /VIN is changed from L level to H level at a time point t1. When the input signal /VIN is changed to H level, the discharge circuit in the voltage level converter VLC is turned ON. Thus the nodes N1, N2, and N4 in the voltage level converter VLC are discharged to VAL. At this time, since the input signal VIN is put in the HiZ state, a current flowing through the transistors NMOS6 and NMOS2 diode-connected between the input signal VIN and VAL is suppressed. A potential ΔVR at the node N1 at this time is generally determined by the impedance of the PMOS transistor included in the buffer HZ_BUF and by the impedance of the transistors NMOS6 and NMOS2. However, since the impedance of the transistor PMOS is large, the node N1 potential can be suppressed to a very small level.

At a time point t2, next, when the input signal /VIN is changed from H level to L level, the discharge circuit is put in the OFF state, so that the charge circuit in the voltage level converter can be operated. At this time, since input signal VIN is changed from the HiZ state to VDH supply state, a voltage is supplied to the node N1 via the transistor NMOS6. The subsequent operation is substantially the same as in the embodiment 5, and explanation thereof is omitted.

As has been explained in the foregoing, when the input signal VIN of the diode-connected transistor NMOS forming the charge circuit has a high level VDH and a low level HiZ, a stationary current between the input signal VIN and VAL during the operation of the discharge circuit can be suppressed, and this embodiment can have the function of the voltage level converter like the embodiment 5.

Explanation has been made in connection with the case where the voltage level converter has such an arrangement as FIG. 14 in FIG. 19. However, even when the voltage level converter of FIG. 17 is employed, substantially the same effects can be obtained by using the buffer HZ_BUF for the input signal VIN.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device having a circuit including a voltage level converter formed on an insulating substrate, said voltage level converter comprising:

a plurality of switching elements having a semiconductor layer made of polycrystalline silicon; and a plurality of capacitors, wherein an input terminal for a first input pulse is connected to first and gate terminals of a first switching element, an input terminal for a second input pulse is connected to a first terminal of a first capacitor, a second terminal of said first capacitor is connected to a second terminal of said first switching element, to first and gate terminals of a second switching element, and also to a first terminal of a third switching element, a second terminal of said second switching element is connected to a gate terminal of a fourth switching element, to a first terminal of a second capacitor, and also to a first terminal of a fifth switching element, a first terminal of said fourth switching element is connected to a high voltage power supply side, an input terminal for a third input pulse corresponding to a phase inversion of said first input pulse and the input terminal of said first input pulse are connected to an input terminal of a reset signal generating circuit, an output terminal of said reset signal generating circuit is connected to a gate terminal of said third switching element, to a gate terminal of said fifth switching element, and also to a gate terminal of a sixth switching element, second terminals of said third, fifth, and sixth switching elements are connected to a low voltage power supply side, a second terminal of said fourth switching element is connected to a second terminal of said second capacitor and to a first terminal of said sixth switching element, and said reset signal generating circuit controls ON and OFF states of said third, fifth, and sixth switching elements in response to said first and third input pulses.

2. A display device according to claim 1, wherein said third input signal applied to the input terminal of said reset signal generating circuit is connected to the first terminal of said first capacitor, said first input signal applied to the input terminal of the reset signal generating circuit is connected to the first terminal of said second capacitor, the second terminal of said second capacitor is connected to the gate terminal of said second switching element and to the first terminal of said first switching element, the second terminal of said first switching element and the second terminal of said second switching element are connected to said low voltage power supply side, the second terminal of said first capacitor is connected to the gate terminal of said first switching element and to the first terminal of said second switching element to form the output terminal of said reset signal generating circuit.

3. A method for controlling a display device according to claim 1, wherein said first input pulse to be input to said voltage level converter supplies a predetermined voltage while said voltage level converter outputs a high voltage of signal, and is electrically cut off from a voltage source for supplying said predetermined voltage while said voltage level converter outputs a low voltage of signal.

* * * * *